US009657507B2

(12) United States Patent
Bacchetti

(10) Patent No.: US 9,657,507 B2
(45) Date of Patent: May 23, 2017

(54) HINGE FOR THE CONTROLLED ROTATABLE MOVEMENT OF A DOOR

(71) Applicant: Luciano Bacchetti, Via Della Fonte (IT)

(72) Inventor: Luciano Bacchetti, Via Della Fonte (IT)

(73) Assignee: IN & TECH S.R.L., Brescia (IT)

( * ) Notice: Subject to any disclaimer, the term of this patent is extended or adjusted under 35 U.S.C. 154(b) by 0 days.

(21) Appl. No.: 14/880,254

(22) Filed: Oct. 11, 2015

(65) Prior Publication Data

US 2016/0060937 A1 Mar. 3, 2016

(51) Int. Cl.
*E05D 11/08* (2006.01)
*E05F 5/02* (2006.01)
(Continued)

(52) U.S. Cl.
CPC ..... *E05F 5/02* (2013.01); *E05D 11/06* (2013.01); *E05D 11/105* (2013.01); *E05F 5/08* (2013.01);
(Continued)

(58) Field of Classification Search
CPC ..... Y10T 16/54038; Y10T 16/5403; Y10T 16/5387; Y10T 16/540255; Y10T 16/534; E05D 11/06; E05D 11/08; E05D 11/081; E05D 11/082; E05D 11/084; E05D 11/085; E05D 11/087; E05D 11/10; E05D 11/105; E05D 2011/1035; E05Y 2900/606; E05Y 2201/49; E05F 5/02; E05F 5/08
See application file for complete search history.

(56) References Cited

U.S. PATENT DOCUMENTS 703,626 A * 7/1902 Upson ..... E05D 11/06 16/375
3,357,041 A * 12/1967 Brueder ..... B60J 1/14 16/338
(Continued)

FOREIGN PATENT DOCUMENTS

DE 19623539 12/1997
EP 1997994 12/2008
(Continued)

*Primary Examiner* — Chuck Mah
(74) *Attorney, Agent, or Firm* — Mark David Torche; Patwrite LLC

(57) ABSTRACT

A hinge for a door anchored to a wall, the hinge including a fixed element coupled to the wall and a movable element coupled to the door. The fixed and movable elements rotate between an open position and a closed position about a first longitudinal axis. One of the movable and fixed elements includes cam means rotating about the first longitudinal axis, the other of the movable and fixed elements including follower means mutually interacting with the cam means for sliding along a second longitudinal axis substantially perpendicular to the first axis. The follower means includes an elastic counteracting element. The cam means includes a first cam element interacting with the follower means for movement from end-stroke positions to an intermediate position and vice-versa. The cam means further includes a second cam element interacting with the follower means for movement from the intermediate position to the end-stroke positions and vice-versa.

16 Claims, 27 Drawing Sheets

(51) Int. Cl.

| | |
|---|---|
| ***E05D 11/06*** | (2006.01) |
| ***E05D 11/10*** | (2006.01) |
| ***E05F 5/08*** | (2006.01) |
| *E05D 5/10* | (2006.01) |

(52) U.S. Cl.

CPC ... *E05D 2005/106* (2013.01); *E05Y 2201/218* (2013.01); *E05Y 2201/224* (2013.01); *E05Y 2201/25* (2013.01); *E05Y 2201/424* (2013.01); *E05Y 2201/638* (2013.01); *E05Y 2800/29* (2013.01); *E05Y 2800/33* (2013.01); *E05Y 2800/678* (2013.01)

(56) References Cited

U.S. PATENT DOCUMENTS 4,177,540 A * 12/1979 Gorton ..... E05D 11/1014 16/237
4,897,873 A * 1/1990 Beutler ..... H04M 1/0216 16/292
5,027,474 A * 7/1991 Bowers ..... E05D 11/1014 16/297
5,052,078 A * 10/1991 Hosoi ..... G06F 1/1616 16/297
5,075,928 A * 12/1991 Bobrowski ..... E05D 5/06 16/273
5,109,573 A * 5/1992 Sherman ..... E05C 17/025 16/341
5,409,297 A * 4/1995 De Filippo ..... B60N 2/4613 16/332
5,412,842 A * 5/1995 Riblett ..... E05D 5/12 16/250
5,638,579 A * 6/1997 Tenney ..... F16M 11/10 16/338
5,765,263 A * 6/1998 Bolinas ..... E05D 7/0423 16/250
5,918,347 A * 7/1999 Morawetz ..... E05D 11/1071 16/274
6,481,055 B2 * 11/2002 Cheng ..... E05D 5/0246 16/250
6,560,821 B2 * 5/2003 Miller ..... E05D 5/0246 16/252
6,574,836 B1 * 6/2003 Steeber ..... E05C 17/045 16/337
6,609,273 B1 * 8/2003 Yamada ..... F16C 11/02 16/332
6,766,561 B1 * 7/2004 Cheng ..... E05D 5/0246 16/235
7,461,432 B2 * 12/2008 Lowen ..... E05D 11/1071 16/334
8,069,535 B2 * 12/2011 Tang ..... G06F 1/1616 16/334
8,108,969 B2 * 2/2012 Ochiai ..... E05D 11/1057 16/334
8,307,513 B1 * 11/2012 Fitzgerald ..... E05D 11/06 16/344
8,347,460 B2 * 1/2013 Minegishi ..... E05D 11/1057 16/333
8,510,914 B2 * 8/2013 Minegishi ..... E05D 11/1057 16/334
8,752,247 B2 * 6/2014 Franchini ..... E05D 11/105 16/334
2012/0117758 A1 5/2012 Walhorn
2013/0067686 A1 * 3/2013 Migliorini ..... E05D 3/16 16/298
2014/0373338 A1 * 12/2014 O'Connor ..... G06F 1/1641 29/592.1
2016/0060930 A1 * 3/2016 Bacchetti ..... E05F 5/08 16/241

FOREIGN PATENT DOCUMENTS

| | | |
|---|---|---|
| FR | 2499618 | 8/1982 |
| WO | 2010049860 | 10/2009 |

* cited by examiner 40
65"
61
13
XXIIIc
XXIIIc
XXIIId
XXIIId
64
62
63"
Y
10
13
92
90
65"
93

67'
61
62
52'
40
10
52'

66
53
61
62
51
40
10

11
X
XXIIIb
XXIIIb
10
20
21

40
21
20
11
XXVb
10
XXVb

65"
61
13
XXVc
XXVc
XXVd
XXVd
64
Y
62
63"
10
13
92
90
65"
93

66
61
62
51
40
10
53

X
67'
61
62
40
52'
10
52'

HINGE FOR THE CONTROLLED ROTATABLE MOVEMENT OF A DOOR

FIELD OF INVENTION

The present invention is generally applicable to the technical field of the closing or damping/control hinges, and particularly relates to a hinge for the controlled rotatable movement of a door, in particular but not exclusively a reinforced door.

BACKGROUND OF THE INVENTION

As known, the closing or damping hinges generally comprise a movable element, usually fixed to a door, a shutter or the like, which movable element is pivoted on a fixed element, usually fixed to a support frame, or to a wall and/or the floor.

More particularly, in the case of concealed hinges for reinforced doors or the like, the fixed element of the hinge is inserted into a support structure that includes a rear tubular counterframe anchored to a wall or like support and a front frame anchored to the counterframe.

On the other hand, the movable element generally includes a connecting plate to be fixed to the door intended to come out from the tubular support structure in the open position and to retract completely within the tubular support structure in the closed position.

Generally, such hinges are purely mechanical, and not allow any kind of adjustment of the opening angle of the door or anyway no control of the movement of the door.

Examples of such known hinges are shown in the documents U.S. Pat. No. 5,075,928 and WO2010049860.

The absence of control makes such hinges extremely dangerous, since due to the great weight of the reinforced door there is the danger of unhinging of the door or the inflection of the tubular support structure to which the hinge is anchored.

Similarly, due to the great weight of the door, the hinge tends to lose the initial position and/or to misalign.

Moreover, the adjustment of the position of the door is difficult and complicated. Furtherly, to do this operation at least two operators are needed.

Another recognized drawback of these hinges is in the high frictions between fixed and movable element, which leads to frequent wear and breakage, with consequent need for continuing maintenance.

SUMMARY OF THE INVENTION

An object of the present invention is to overcome at least partly the above mentioned drawbacks, by providing a hinge having high performances, simple construction and low cost.

Another object of the invention is to provide a hinge which allows controlling the movement of the door upon its opening and/or its closing.

Another object of the invention is to provide a strong and reliable hinge.

Another object of the invention is to provide a hinge having extremely small dimensions.

Another object of the invention is to provide a hinge suitable for supporting very heavy doors and shutters.

Another object of the invention is to provide a hinge that has a minimum number of constituent parts.

Another object of the invention is to provide a hinge suitable to maintain the exact closing position during time.

Another object of the invention is to provide a hinge that is safe.

Another object of the invention is to provide a hinge that is easy to install.

Another object of the invention is to provide a hinge that simplifies the operations of maintenance and/or replacement thereof.

Another object of the invention is to provide a hinge which allows a simple adjustment of the door to which it is connected.

Another object of the invention is to provide a hinge that is reversible, i.e. to be used straight or upside down without changing its behavior.

These objects, as well as other which will appear clearer hereafter, are fulfilled by a hinge having one or more of the features herein disclosed, claimed and/or shown.

Advantageous embodiments of the invention are defined in accordance with the dependent claims.

BRIEF DESCRIPTION OF THE DRAWINGS

Further features and advantages of the invention will appear more evident upon reading the detailed description of some preferred, non-exclusive embodiments of a hinge 1, which is described as non-limiting examples with the help of the annexed drawings, in which.

DETAILED DESCRIPTION OF SOME PREFERRED EMBODIMENTS

With reference to the above figures, the hinge according to the invention, generally indicated 1, is particularly useful for the rotatable possibly controlled movement during opening and/or closing of a closing element D, such as a reinforced door, which may be anchored to a stationary support structure, such as a wall, a floor or a ceiling.

In a preferred but not exclusive embodiment, as shown in FIGS. 1 to 17*c*, the hinge 1 may be concealedly inserted in a tubular support structure, which may be formed in a per se known manner by a rear counterframe CF, which can be anchored to the wall W or like support, and by a front frame F anchored to the counterframe CF.

In particular, in a first embodiment shown in FIGS. 1 to 13*d*, the hinge 1 can be anchored to the frame F by means of the plate $P_1$, maintained in the operative position by screw means $V_1$.

On the other hand, in a second embodiment shown in FIGS. 14 to 17*c*, the hinge 1 can be configured as a concealed "Anuba" hinge anchored to the frame F by the plate $P_2$.

In both embodiments, the hinge 1 is concealedly insertable in the support structure formed by the tubular rear counterframe CF and the front frame F.

On the other hand, in FIGS. 18 to 25*d* an embodiment of the hinge 1 is shown that is not concealed. In particular, this embodiment is a hinge of the type "Anuba" susceptible to be mounted externally to a door, such as a reinforced door, as shown in FIGS. 20*a* to 21*b*.

The above embodiments have certain common features or sets of features and some features or sets of features which are peculiar of certain embodiments. Unless otherwise specified, in the present document a single identification number generically identifies the common features, the particular features of one or more embodiments being further specified.

Figure 1:
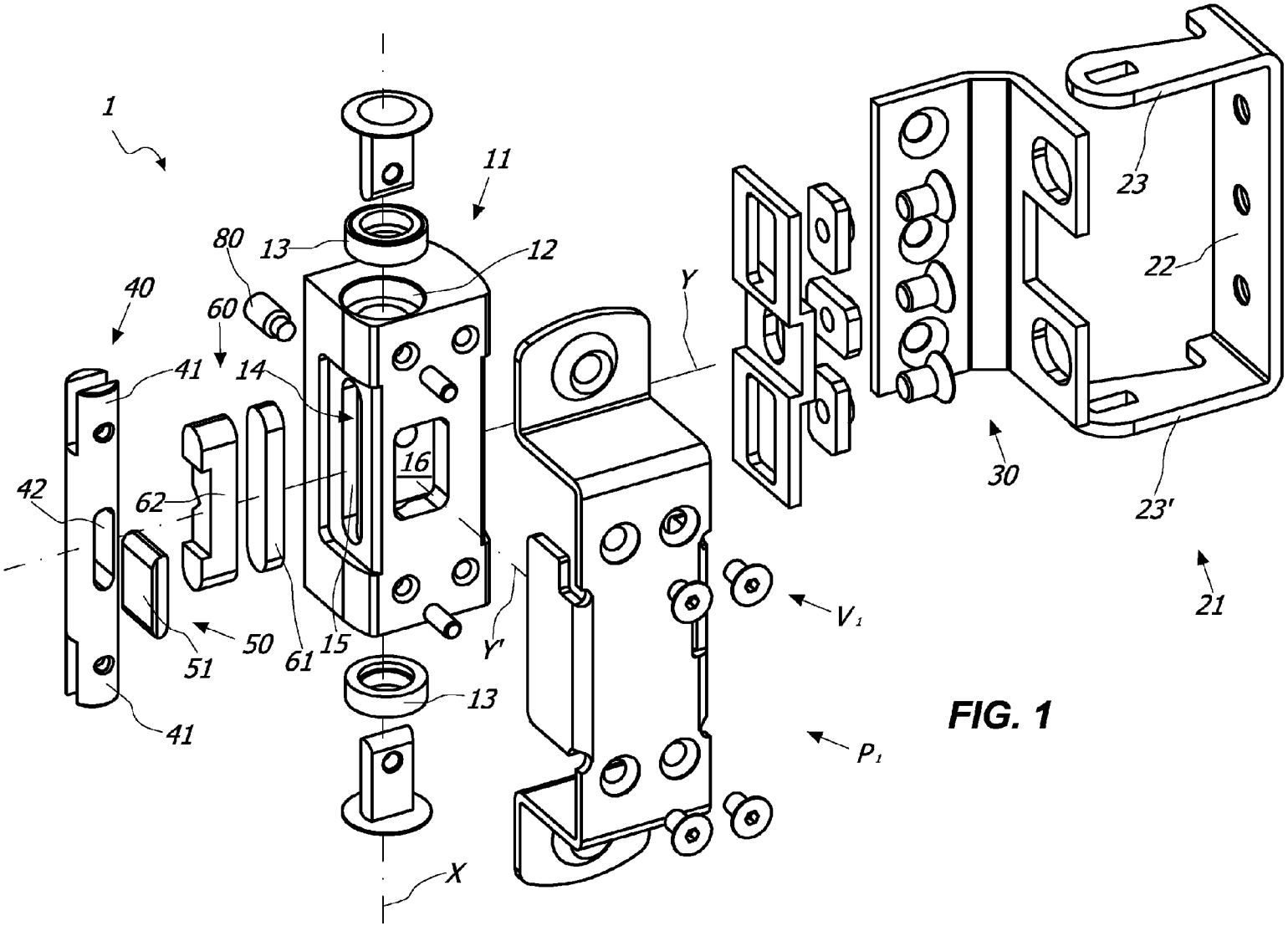
FIG. 1 is an exploded view of a first embodiment of the hinge 1.
Figure 2A:
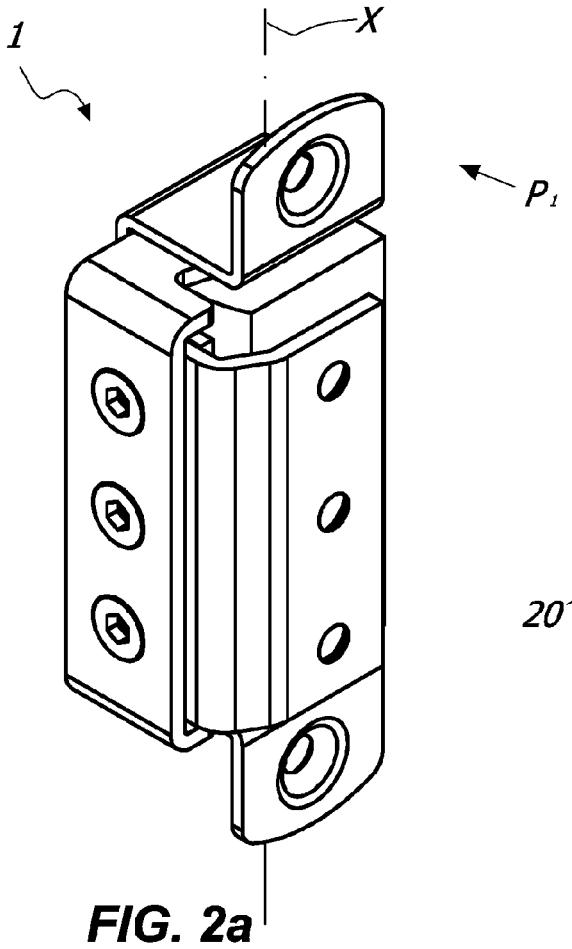
FIGS. 2*a* and 2*b* are respectively perspective and upper views of the embodiment of the hinge 1 of FIG. 1 in the closed position.
Figure 2B:
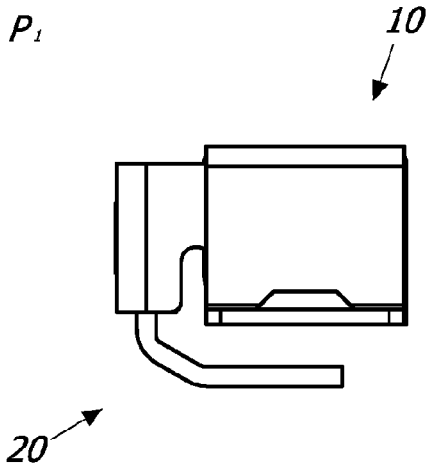
Figure 3B:
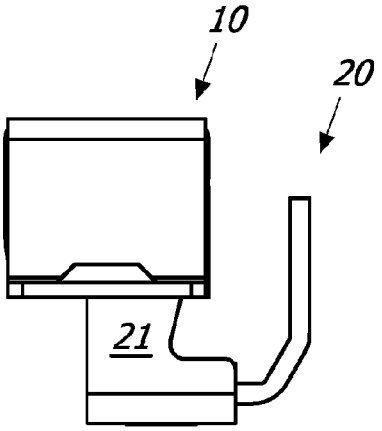
FIGS. 3*a* and 3*b* are respectively perspective and upper views of the embodiment of the hinge 1 in the open position.
Figure 3A:
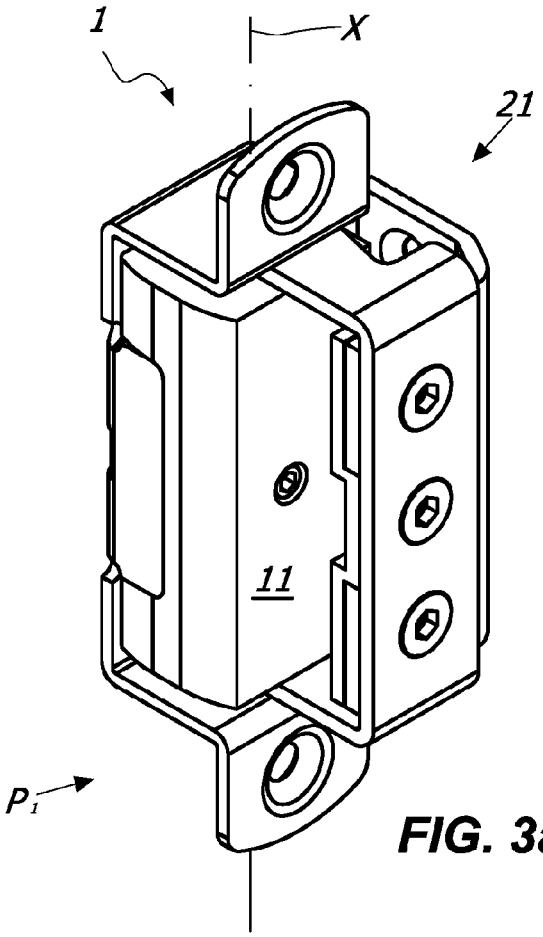
Figure 4:
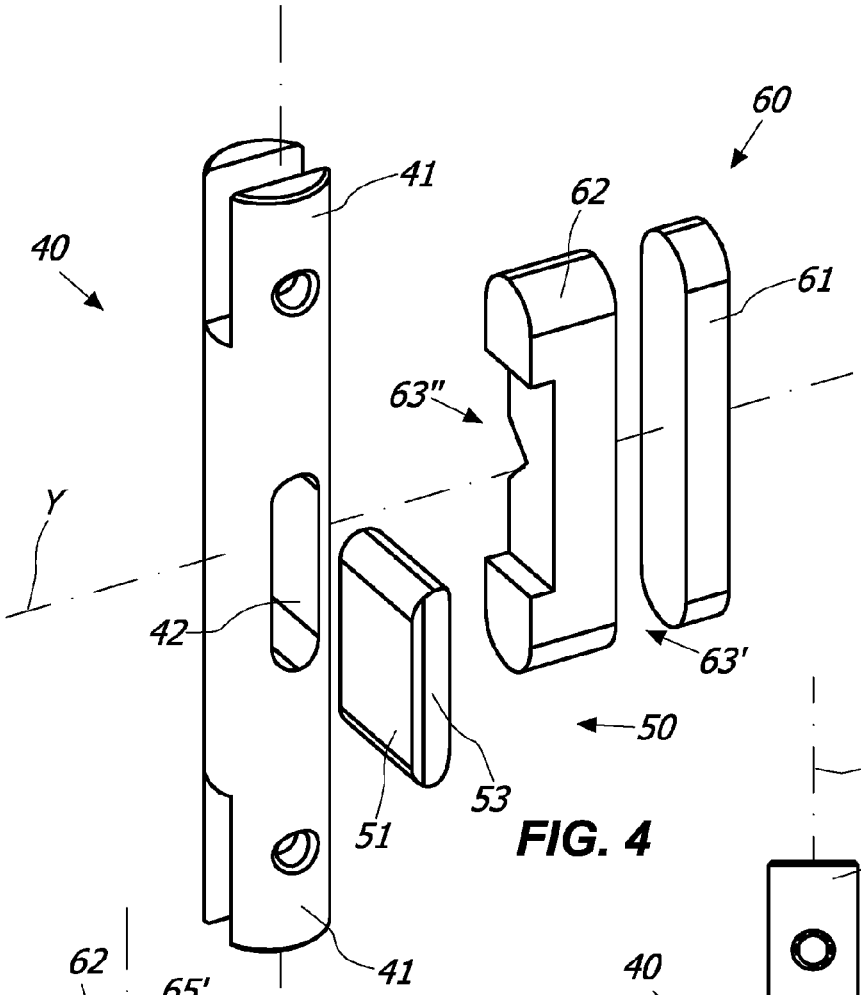
FIG. 4 is a schematic view of the assembly pivot 40—cam 51—interface element 62—elastic counteracting element 61 to be used in the embodiment of the hinge 1 of FIG. 1.
Figure 5:
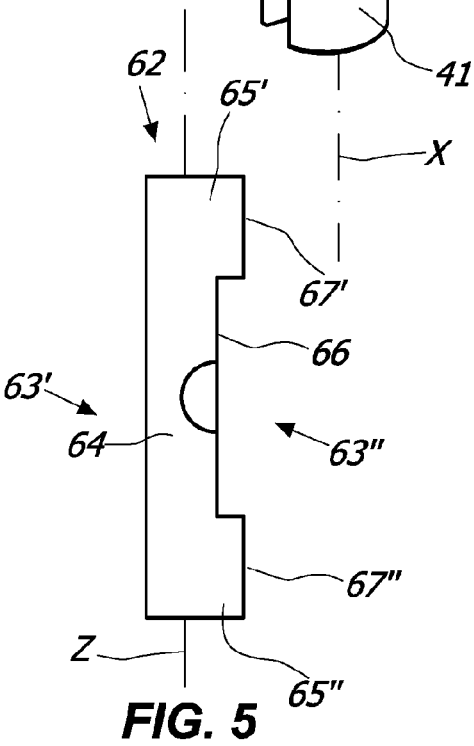
FIGS. 5 and 6 are respectively side views of a first embodiment of the interface element 62 and the pivot 40 to be used in the embodiment of the hinge 1 of FIG. 1.
Figure 6:
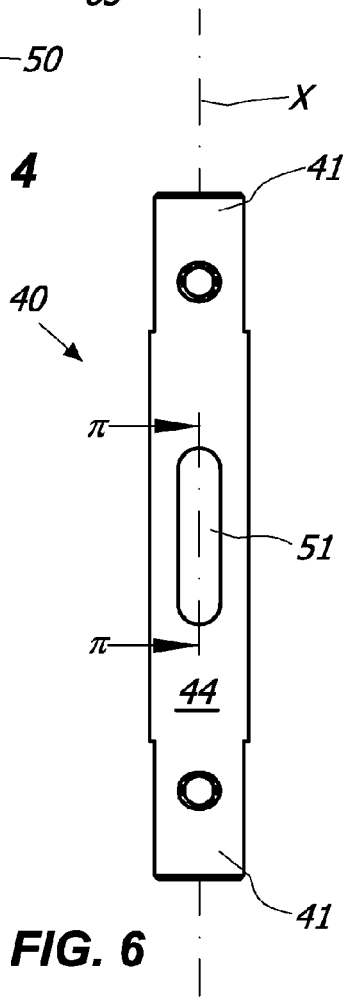

Conveniently, the hinge 1 may include a fixed element 10 to be fixed to the stationary support W, for example by the frame F or the counterframe CF, on which a movable element 20 is pivoted to rotate about a longitudinal axis X, which may be substantially vertical, between an open position, shown for example for the above first embodiment in FIGS. 3*a* and 3*b*, and a closed position, shown for example for the same embodiment in FIGS. 2*a* and 2*b*.

Advantageously, the fixed element 10 may include a hinge body 11 anchored to the stationary support W, while the movable element 20 may include means 21 for fixing to the door D.

Figure 15A:
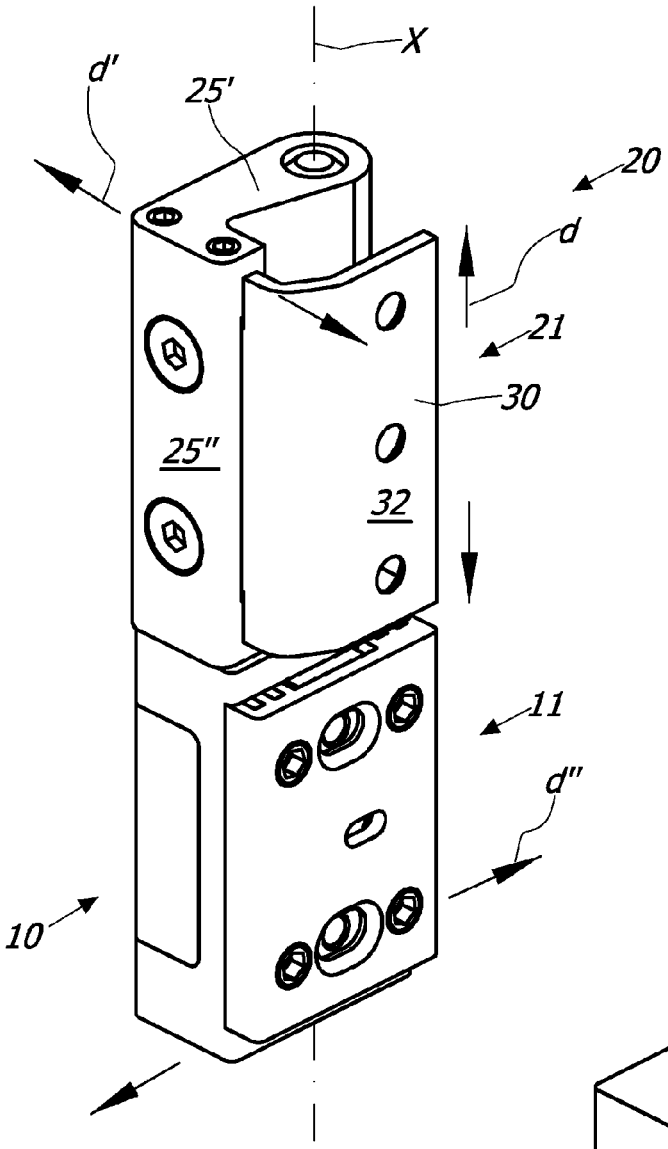
FIGS. 15*a* and 15*b* are perspective views of the embodiment of the hinge 1 of FIG. 14, respectively in the open and the closed position.
Figure 15B:
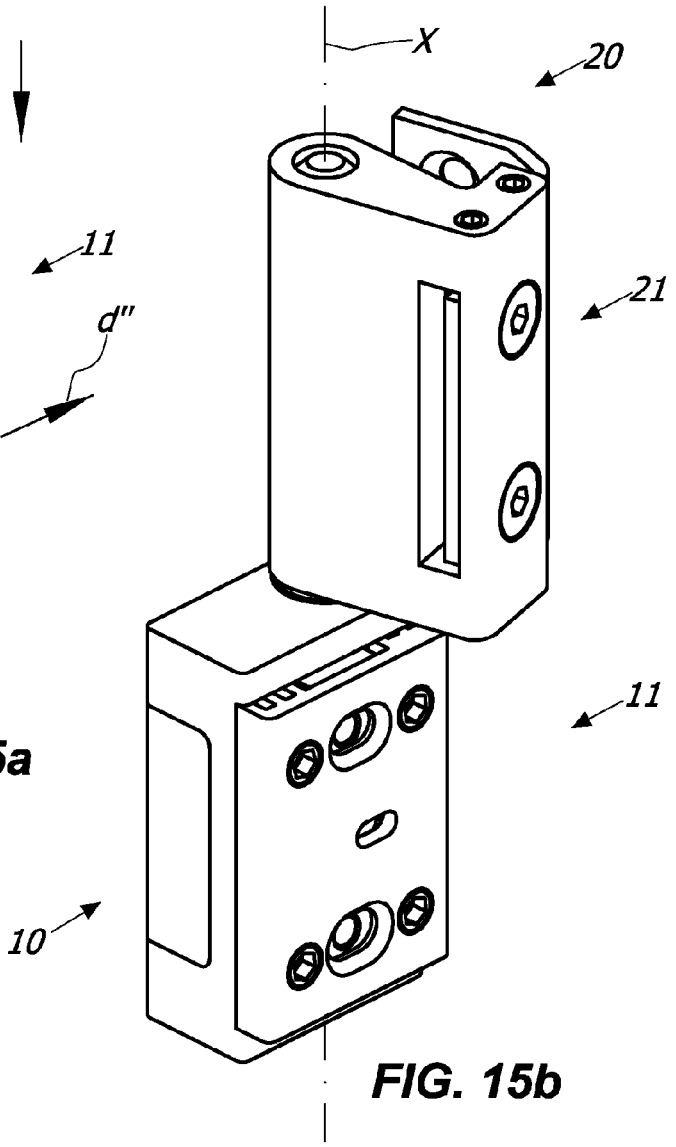
Figure 16A:
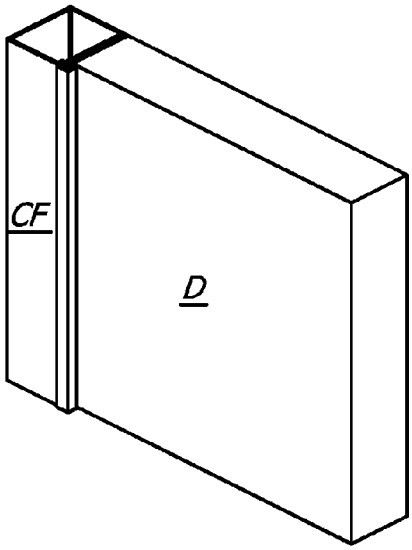
FIGS. 16*a* and 16*b* are respectively perspective and upper views of the embodiment of the hinge 1 of FIG. 14 in which the movable element 20 is mounted on a door D and the fixed element 10 is mounted on a frame F, the door D being in the closed position.
Figure 16B:
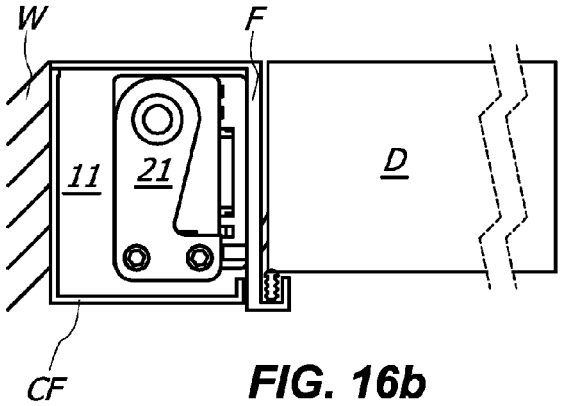
Figure 16C:
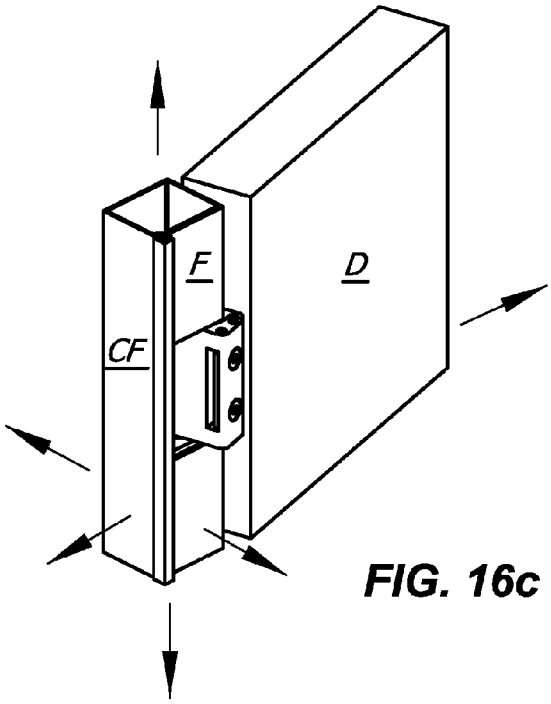
FIGS. 16*c* and 16*d* are respectively perspective and upper views of the embodiment of the hinge 1 of FIG. 14 in which the movable element 20 is mounted on a door D and the fixed element 10 is mounted on a frame F, the door D being in the open position.
Figure 16D:
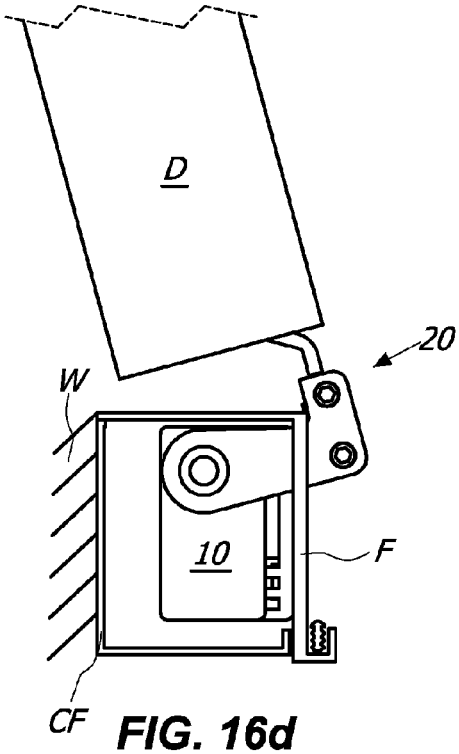

In the embodiments of the hinge 1 shown in FIGS. 1 to 17*c* the hinge body 11 is concealedly insertable within the support structure formed by the tubular rear counterframe CF and the front frame F, while the connecting means 21 may be defined by a connecting plate susceptible to extend from the tubular support structure in the open position of the door D, as shown for example in FIGS. 16*c* and 16*d*, and to retract within the same tubular support structure in the closed position of the door D, as shown for example in FIGS. 16*a* and 16*b*.

In particular, in the first embodiment shown in FIGS. 1 to 13*d* the connecting plate 21 may be configured according to the teachings of the Italian patent application VI2012A000156, in the name of the same Applicant, and may therefore be substantially "C"-shaped, with a central portion 22 susceptible to be connected with the door D by means of the mounting bracket 30 and a pair of end portions 23, 23' mutually faced each other and operatively connected with the box-shaped body 11.

On the other hand, the connecting plate 21 of the embodiment of the hinge 1 shown in FIGS. 14 to 17*c* is rotatably connected to the body 11 by means of the hinge pivot 40, which will be better described later.

Analogously, in the embodiment shown in FIGS. 18 to 25*d* the means 21 for connecting to the door D are defined by a connecting plate 11', which is rotatably connected to the body 11 by the hinge pivot 1.

In all embodiments of the hinge 1 shown in FIGS. 1 to 25*d*, the hinge body 11 may include a passing-through seat 12 defining the axis X within which is inserted with minimal clearance the pivot 40, which may be connected to the fixing means 21.

According to the embodiment of the hinge 1, the pivot 40 may have one or both ends 41 mutually connected with the fixing means 21.

In this way, the pivot 40 is unitary movable with the door D between the open and closed positions. Thanks to this feature, the hinge 1 is able to support even very heavy doors D without misalignments or changing of the behaviour.

Suitably, at the ends of the passing-through seat 12 of the box-shaped body 11 respective anti-friction elements 13 may be placed, such as bearings.

This allows the movable element 20 to rotate about the axis X with minimum friction, so that the hinge 1 is able to support even very heavy doors D.

The hinge body 11 may internally include a working chamber 14 defining a second axis Y which is substantially perpendicular to the first axis X defined by the passing-through seat 12 for the pivot 40.

Figure 7A:
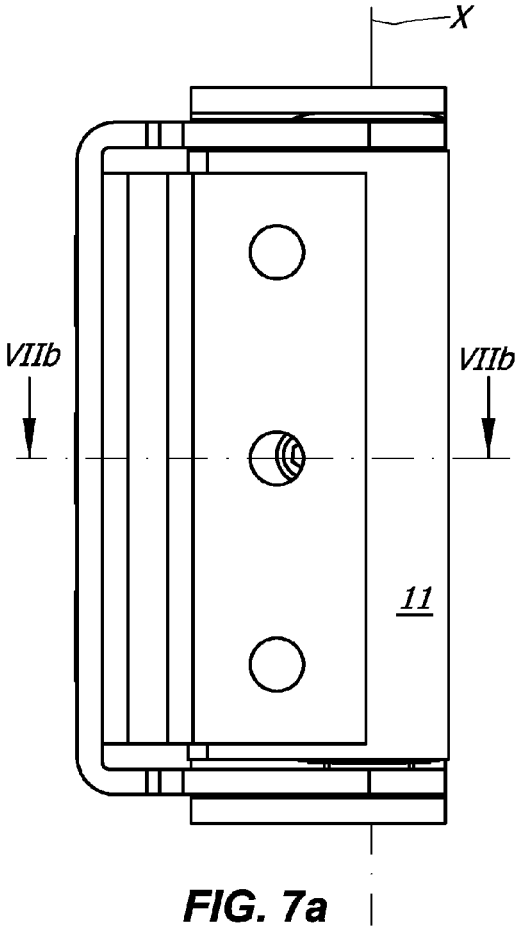
FIGS. 7*a*, 7*b* and 7*c* are respective side view and views sectioned along a plane VIIb-VIIb and along a plane VIIIc-VIIc views of the embodiment of the hinge 1 of FIG. 1 that includes the first embodiment of the interface element 62 and the pivot 40 of FIGS. 5 and 6, the hinge being in the closed position.
Figure 7C:
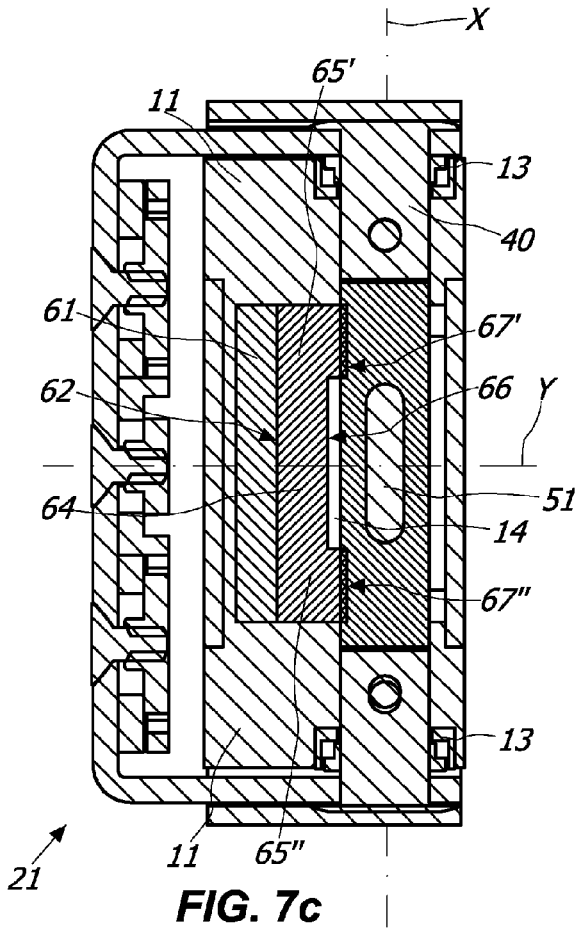
Figure 7B:
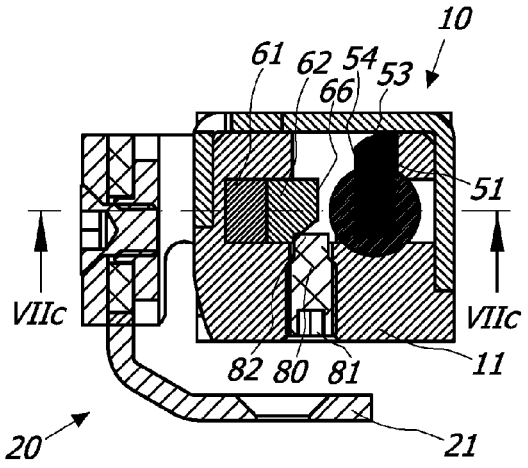
Figure 9A:
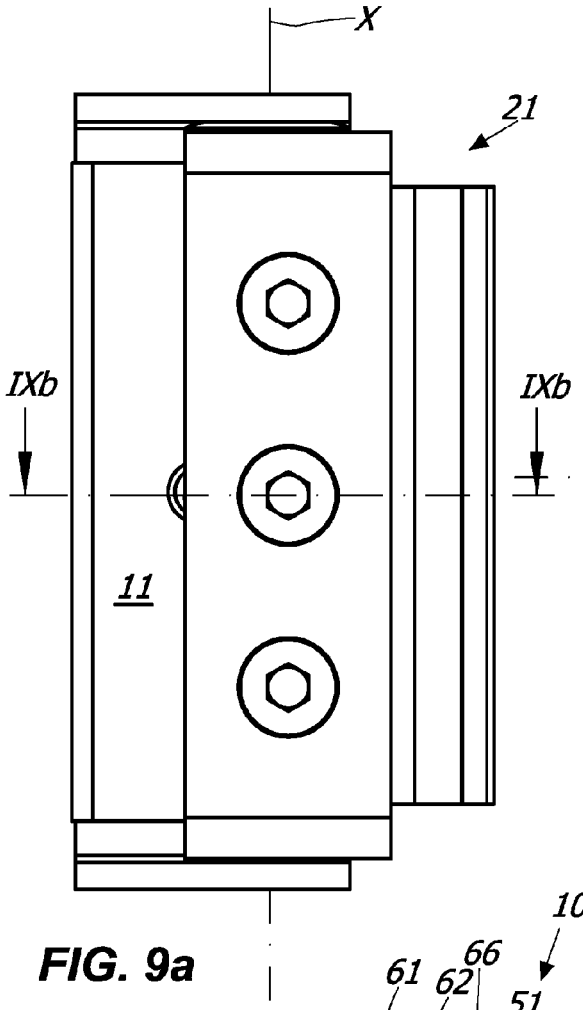
FIGS. 9*a*, 9*b* and 9*c* are respective side view and views sectioned along a plane IXb-IXb and along a plane IXc-IXc of the embodiment of the hinge 1 of FIG. 1 that includes the first embodiment of the interface element 62 and the pivot 40 of FIGS. 5 and 6, the hinge being in the fully open position.
Figure 9C:
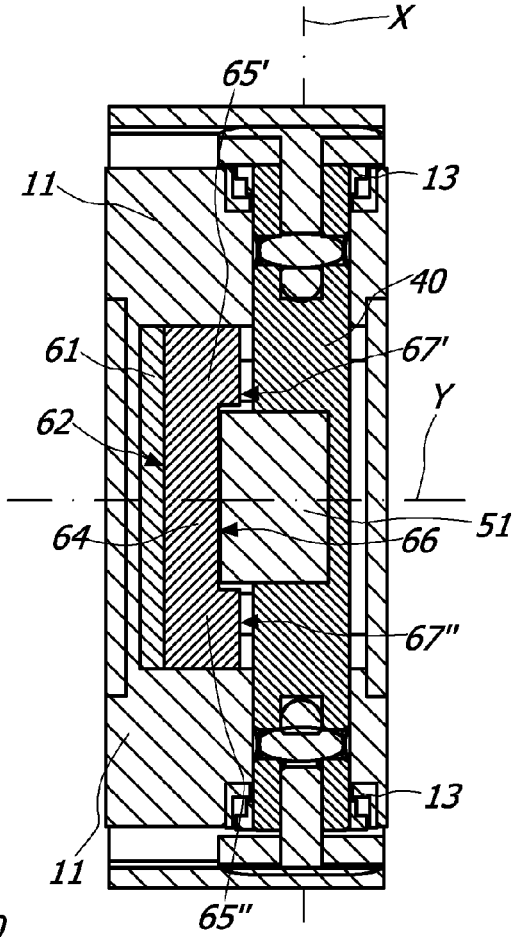
Figure 9B:
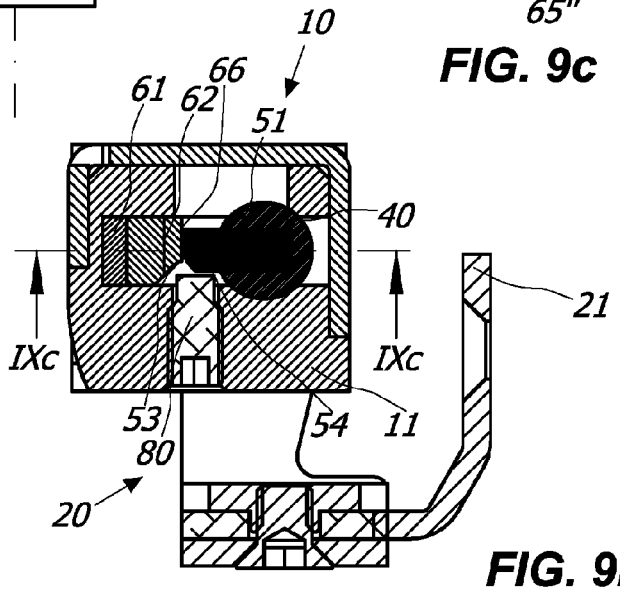
Figure 10A:
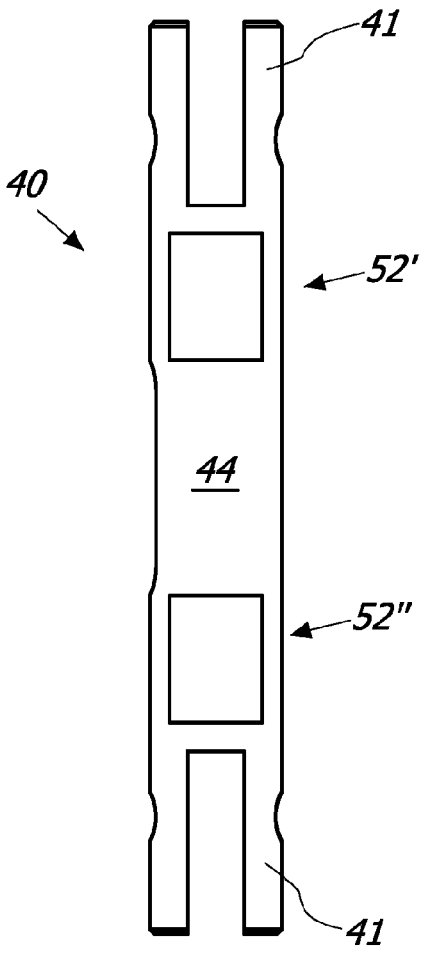
FIGS. 10*a* and 10*b* are side views of a second embodiment of the pivot 40 to be used in the embodiment of the hinge 1 of FIG. 1.
Figure 10B:
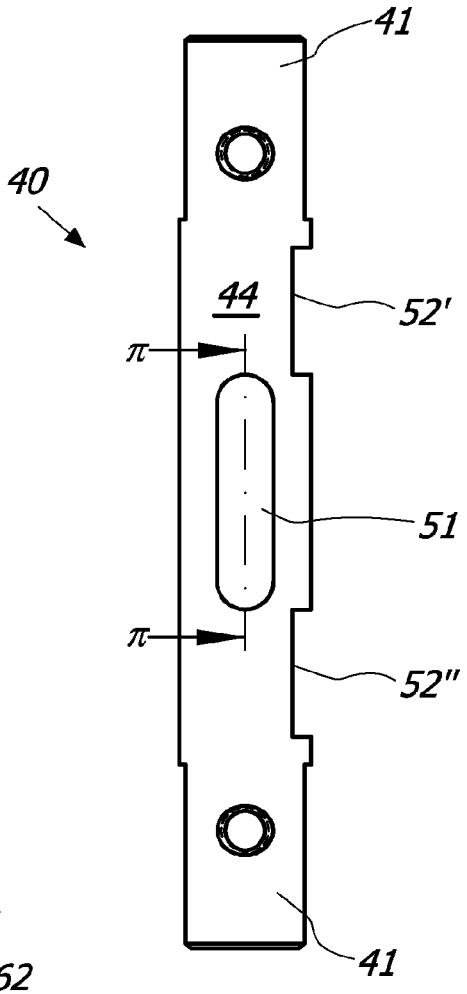
Figure 10C:
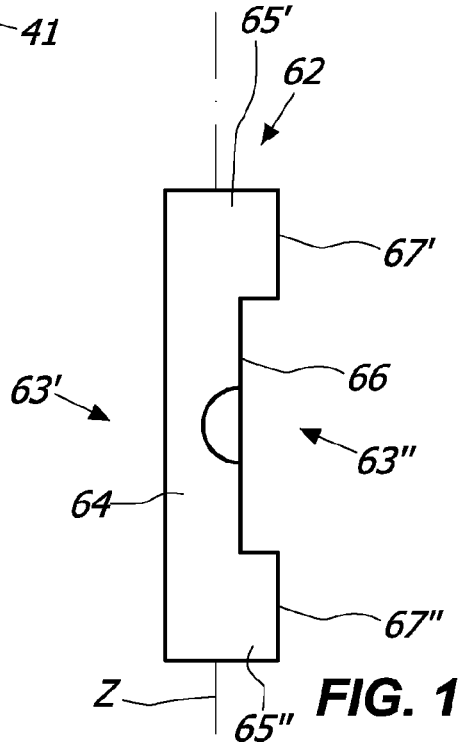
FIG. 10*c* is a side view of a second embodiment of the interface element 62 to be used in the embodiment of the hinge 1 of FIG. 1.
Figure 11A:
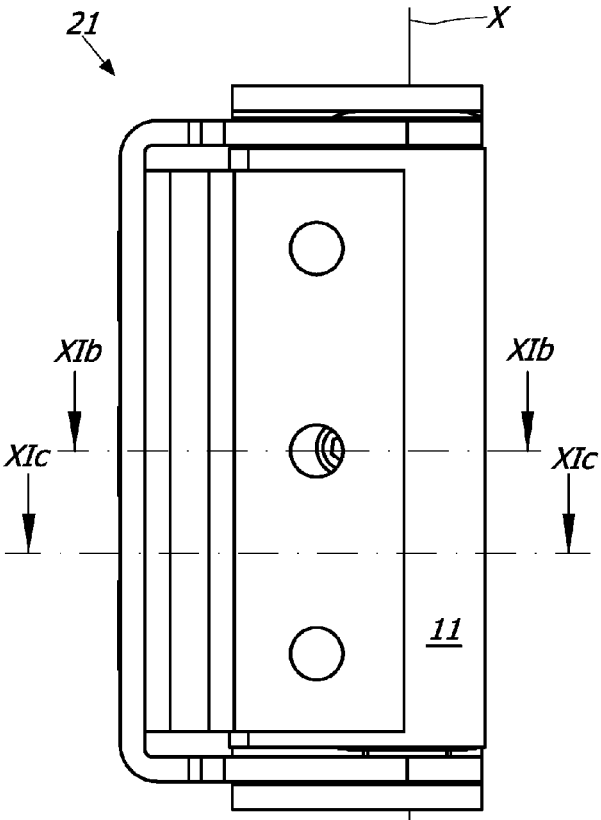
FIGS. 11*a*, 11*b*, 11*c* and 11*d* are respective side view and views sectioned along a plane XIb-XIb, along a plane XIc-XIc and along a plane XId-XId of the embodiment of the hinge 1 of FIG. 1 which includes the second embodiment of the pivot 40 of FIGS. 10*a*, 10*b* and the interface element 62 of FIG. 10*c*, the hinge being in the closed position.
Figure 11D:
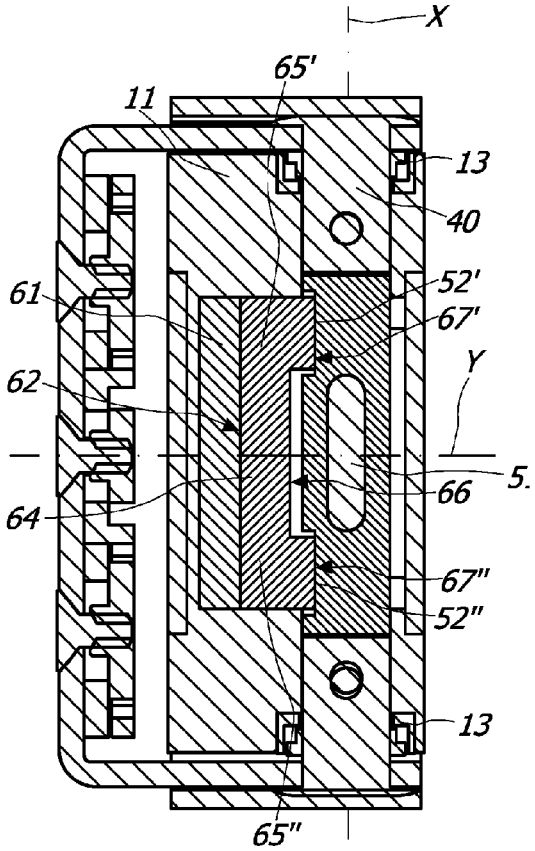
Figure 11B:
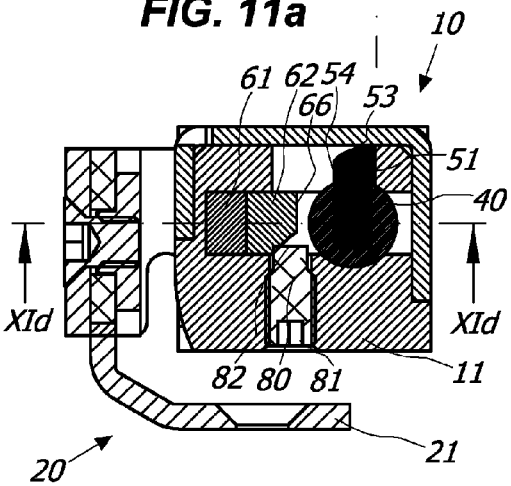
Figure 11C:
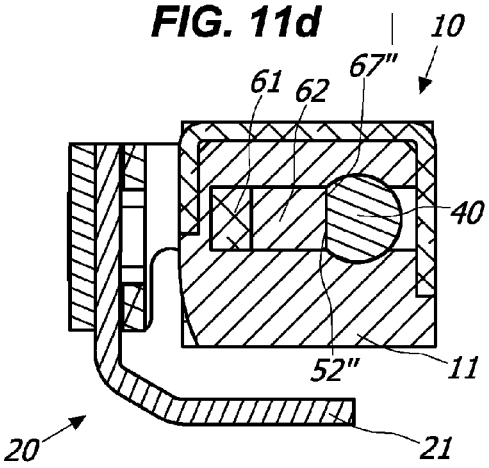
Figure 12A:
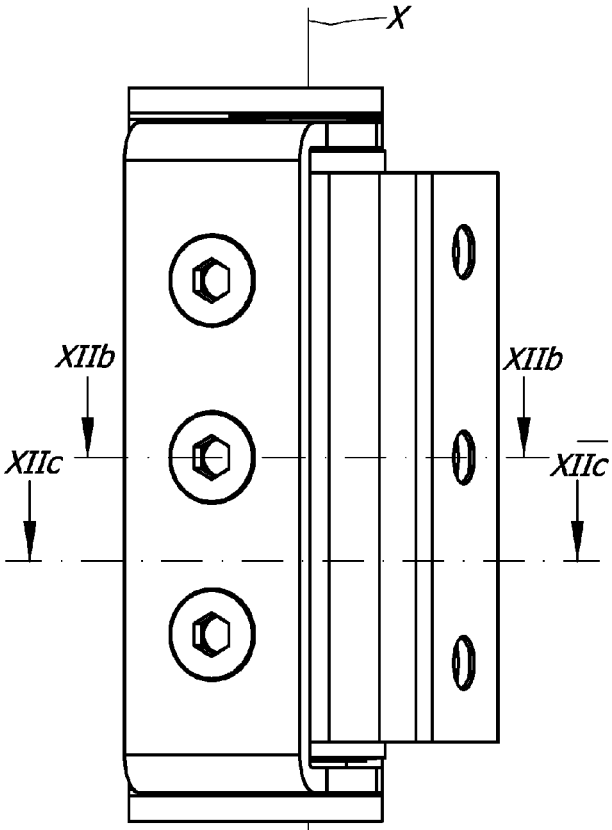
FIGS. 12*a*, 12*b*, 12*c* and 12*d* are respective side view and views sectioned along a plane XIIb-XIIb, along a plane XIII-XIIc and along a plane XIId-XIId of the embodiment of the hinge 1 of FIG. 1 which includes the second embodiment of the pivot 40 of FIGS. 10*a*, 10*b* and the interface element 62 of FIG. 10*c*, the hinge being in a partially open position.
Figure 12D:
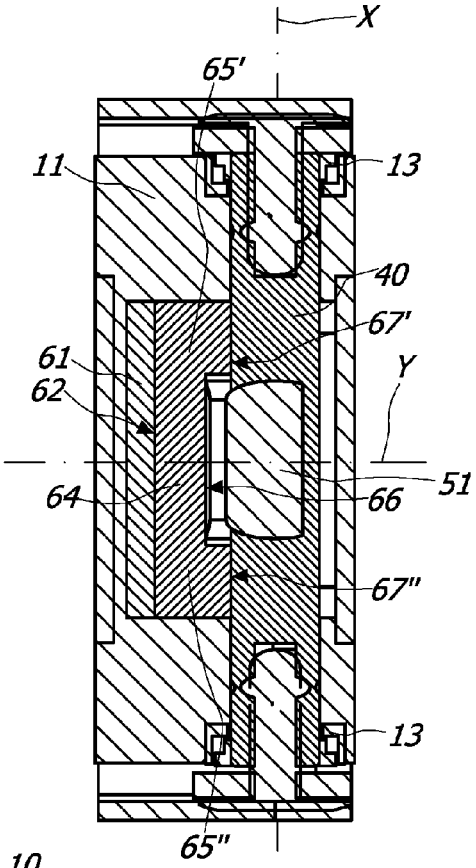
Figure 12B:
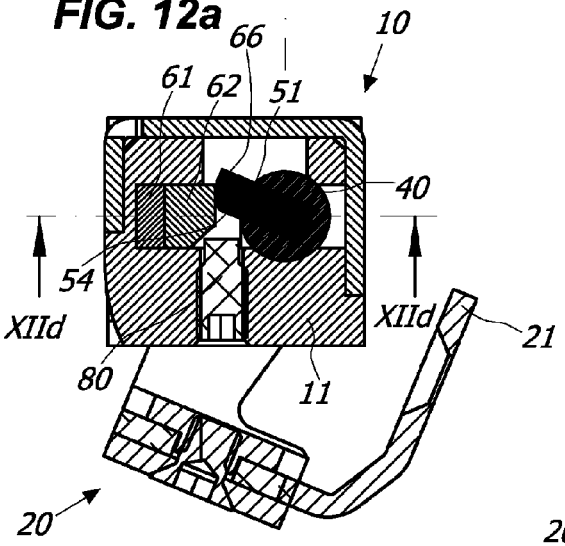
Figure 12C:
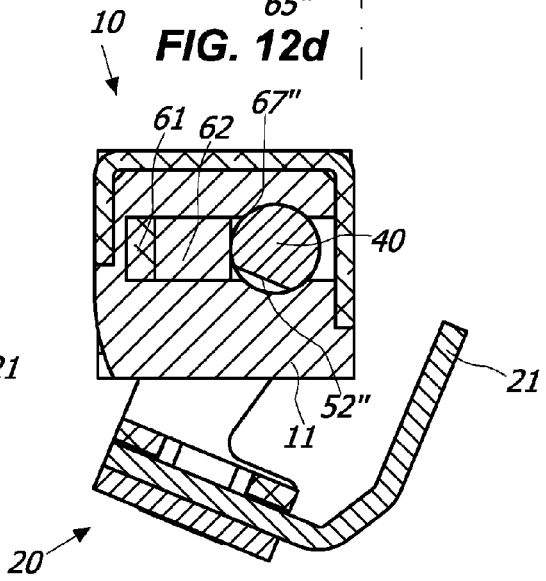
Figure 13A:
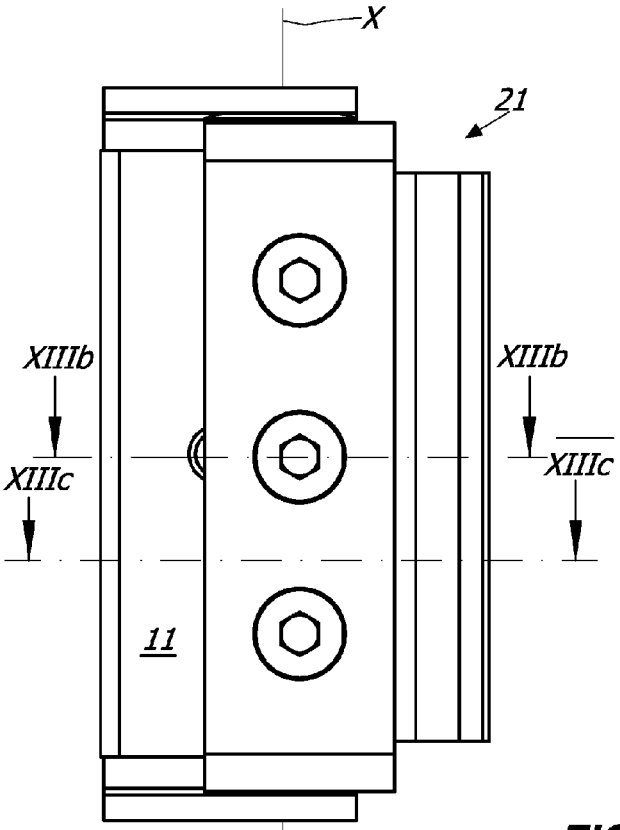
FIGS. 13*a*, 13*b*, 13*c* and 13*d* are respective side view and views sectioned along a plane XIIIb-XIIIb, along a plane XIIIc-XIIIc and along a plane XIIId-XIIId of the embodiment of the hinge 1 of FIG. 1 which includes the second embodiment of the pivot 40 of FIGS. 10*a*, 10*b* and the interface element 62 of FIG. 10*c*, the hinge being in the fully open position.
Figure 13D:
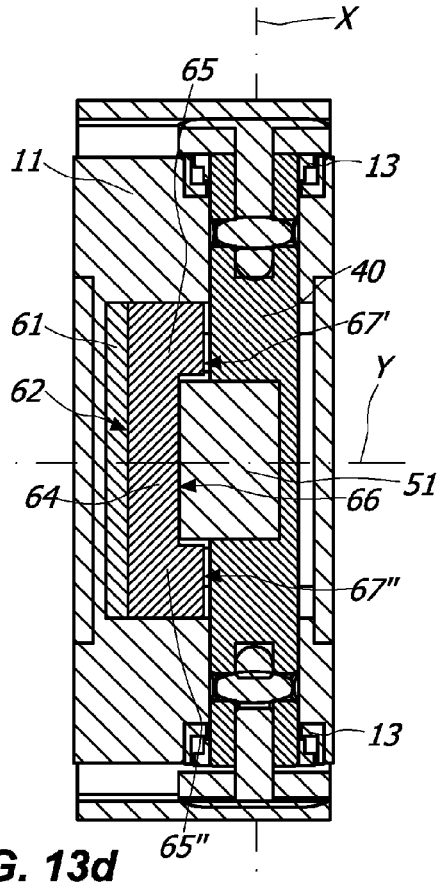
Figure 13B:
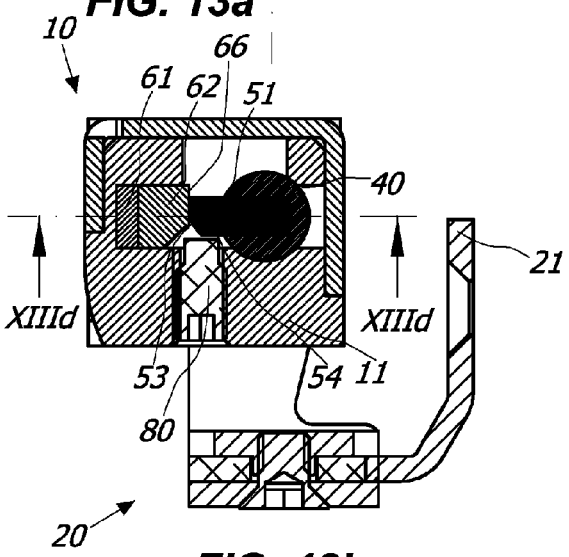
Figure 13C:
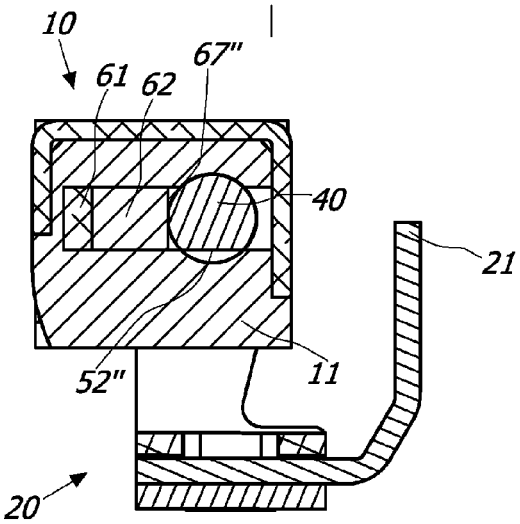
Figure 14:
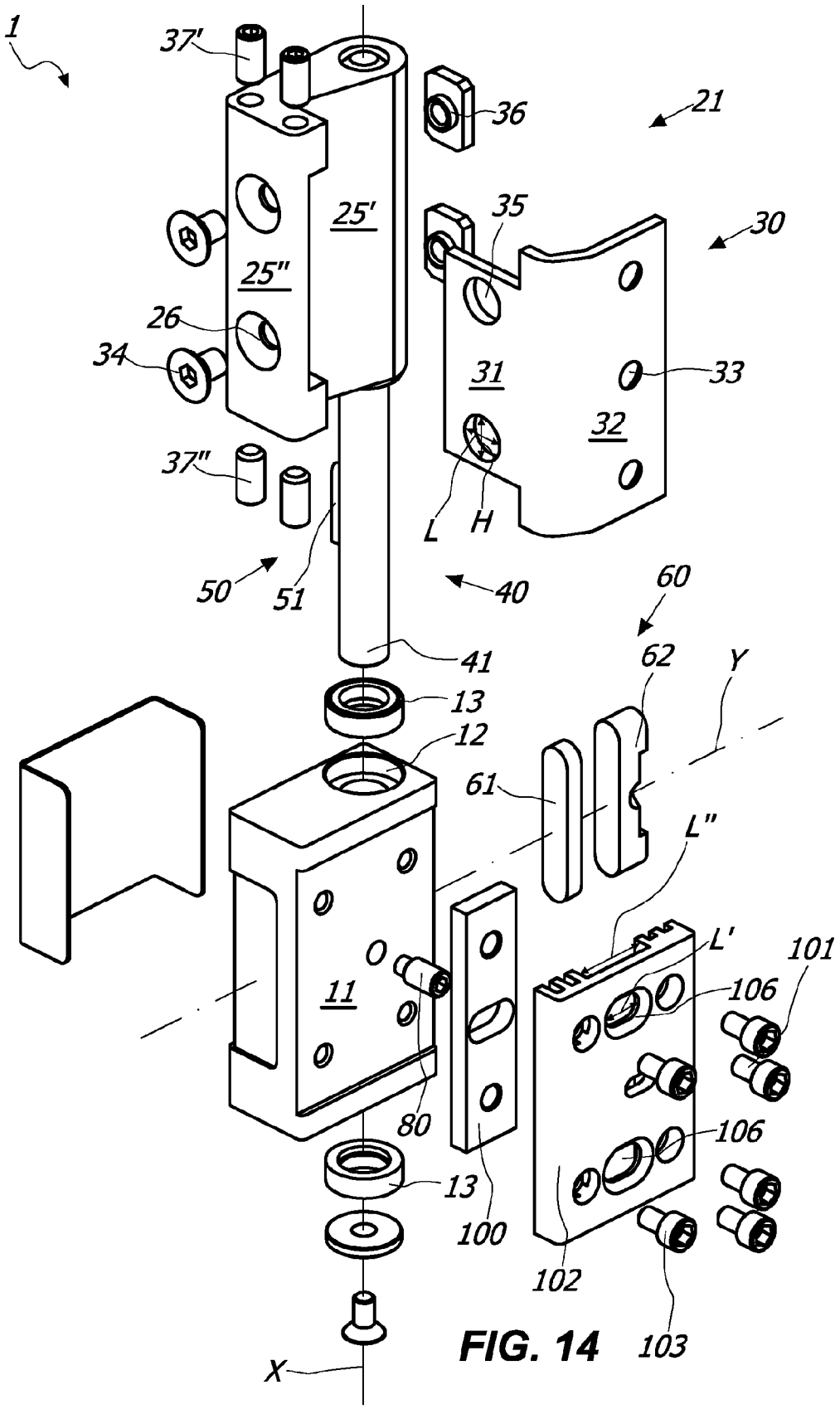
FIG. 14 is an exploded view of a second embodiment of the hinge 1.

Suitably, the pivot 40 may include cam means 50 rotating around the axis X, while the working chamber 14 may include follower means 60 interacting with the former to slidably move along the axis Y between a first and a second end-stroke position, shown for example in FIGS. 7*b* and 9*b*.

The follower means 60 may include an elastic counteracting element susceptible to elastically oppose the pushing force imparted by the cam means. As non-limiting example, the elastic counteracting element may include, respectively may consist of, a spring, a nitrogen cylinder or a portion of polymeric material.

In a preferred but not exclusive embodiment of the hinge 1, the elastic counteracting element may consist of an elastomer body 61, which may be plate-shaped, disk-shaped or cylindrical-shaped.

Advantageously, the elastomer body 61 may be made of a polyurethane elastomer of the compact type, for example Vulkollan®. Suitably, the elastomer may have a Shore A hardness of 50 ShA to 95 ShA, preferably of 70 ShA to 90 ShA. More preferably, the elastomer body 61 may have a Shore A hardness of 80 ShA.

The use of the elastomer in place of the classic spring allows for a very high pushing and/or braking force, in a very small space. In fact, the stroke of the elastomer body 61 along the axis Y may be of some millimeters, for example 2-4 mm.

Moreover, the elastomer body 61 allows to obtain a braking effect of great efficiency in a purely mechanical hinge without the use of oil or like hydraulic damping means, for example during the opening as in the embodiments shown in FIGS. 1 to 25*d*.

In fact, in such embodiments upon the opening of the door D the elastic counteracting element 61 passes from the first to the second end-stroke position and remains in this position until the closing of the door by a user, so that the hinge 1 is a control hinge braked during opening.

Moreover, the follower means 60 may advantageously include an interface element 62 having a first end 63' which interacts with the elastic counteracting element 61 and a second end 63" interacts with the cam means 50.

Advantageously, the interface element 62 may have a substantially "C"-shape with a central elongated portion 64 defining a third longitudinal axis Z substantially parallel to the axis X and perpendicular to the axis Y and a pair of end transverse appendices 65', 65" substantially perpendicular to the axis X and parallel to the axis Y.

Both the elongated central portion 64 and the end transverse appendices 65', 65" may include respective operating surfaces 66, 67', 67" placed at the front end 63", the function of which is better explained later.

Moreover, the pivot 40 may suitably include the cam means 50, so that the latter rotate unitary with the former around the axis X. Advantageously, the cam means 50 may include one or more cam elements susceptible to interact with the follower means 60.

More particularly, in the embodiments shown in FIGS. 1 to 9*c* and 14 to 17*c* the cam means 50 may include a single cam element, while in the remaining embodiments the cam means 50 may include two cam elements.

The cam elements may have different configuration, according to the embodiment.

For example, in the embodiments shown in FIGS. 1 to 9*c* and 14 to 17*c*, the single cam element may be defined by a plate-shaped body 51 insertable transversely in a removable manner within a seat 42 of the pivot 40 so that a portion of the former extends from the latter. This configuration simplifies the assembly of the hinge 1.

On the other hand, the plate-shaped body 51 may be integrated into the pivot 40 in an unremovable manner.

Suitably, the plate-shaped body 51 may have a front peripheral edge 53 susceptible to interact with the interface element 62, for example in correspondence of the operating surface 66. To this end, the front peripheral edge 53 may be appropriately rounded.

In this way, the interface element 62 progressively compresses the elastomer body 61 upon the opening of the door D. The elastomer body 61 may further be susceptible to remain in the configuration elastically deformed until the closing of the door D by a user. In other words, the hinge 1 is elastically braking upon opening.

Figure 8A:
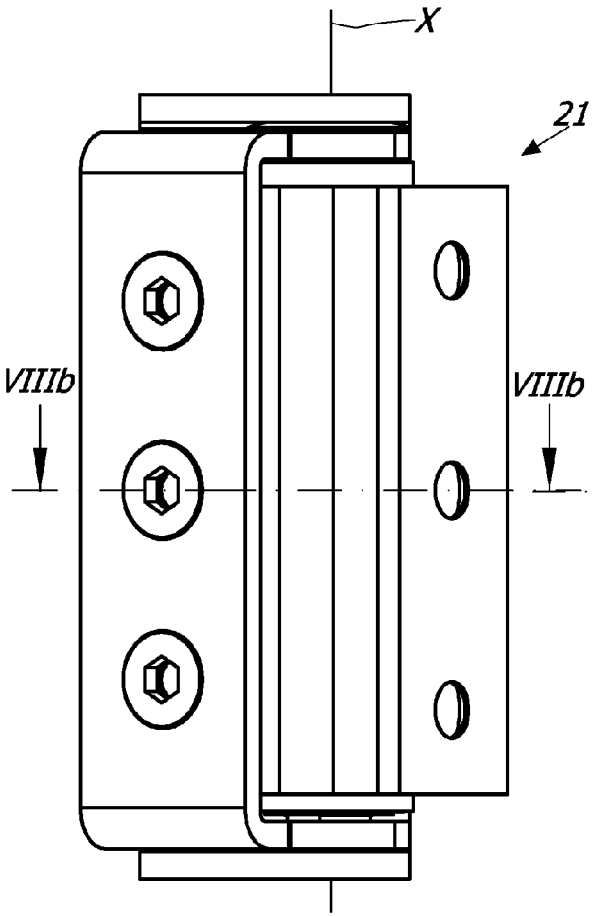
FIGS. 8*a*, 8*b* and 8*c* are respective side view and views sectioned along a plane VIIb-VIIb and along a plane VIIk-VIIk of the embodiment of the hinge 1 of FIG. 1 that includes the first embodiment of the interface element 62 and the pivot 40 of FIGS. 5 and 6, the hinge being in a partly open position.
Figure 8C:
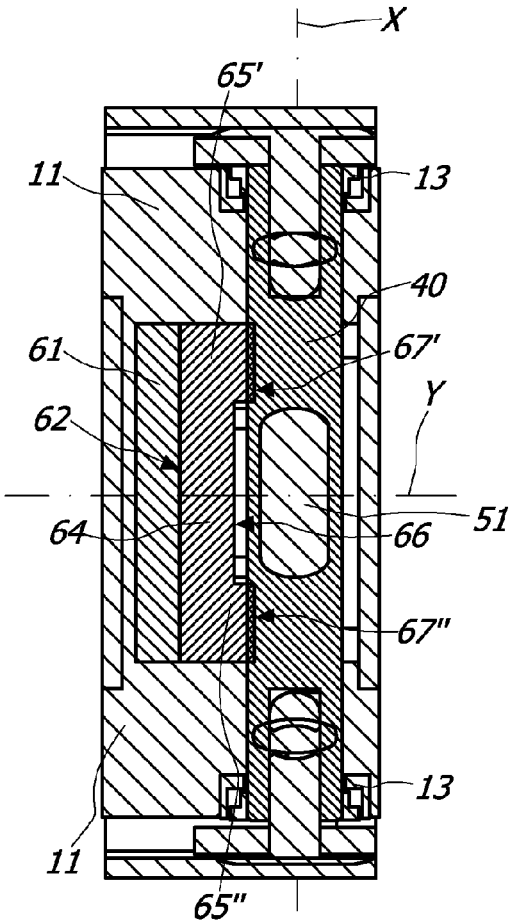
Figure 8B:
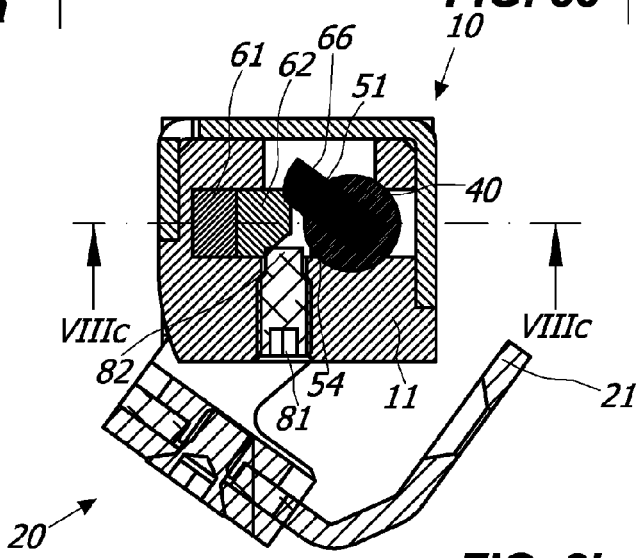

In such embodiments the hinge 1 may be configured so that the cam element 51 interacts with the operating surface 66 after an angular rotation of the door D, for example 45°, as particularly shown in FIGS. 7*b* and 8*b*. Following interaction with the interface element 62, the cam element 51 compresses the elastomer body 61, so that the hinge is mechanically braked upon opening during the subsequent angular rotation, for example the next 45°, as particularly shown in FIGS. 8*b* and 9*b*. In other words, the first angular rotation is free, that is not braked, while the subsequent angular rotation is braked by the braking action of the elastomer body 61.

In the embodiments shown in FIGS. 10*a* to 13*d* and 18 to 25*d* two cam elements may be provided, in particular a pair of first cam elements 52', 52" susceptible to interact with the operating surfaces 67', 67" of the interface element 62 and a second cam element consisting of the plate-shaped element 51 which is susceptible to interact with the operating surface 66.

The first cam elements 52', 52" may be defined by a pair of substantially flat faces formed on the outer surface 44 of the pivot 40, in longitudinally staggered positions so as to be operatively in contact with the operating planar surfaces 67', 67" of the interface element 62.

Conveniently, the cam means 50 and the follower means 60 may be configured so that the substantially flat faces 52', 52" and the operative surfaces 67', 67" are substantially parallel and in mutual contact when the door D is in the closed position, as shown for example in FIGS. 11*a* to 11*d*, and are substantially perpendicular and spaced apart each other when the door D is in the open position, as shown for example in FIGS. 13*a* to 13*d*.

The plate-shaped element 51 may further define a plane π substantially perpendicular to the substantially planar faces 52', 52".

In this way, it is possible to achieve a full control on the door D upon the opening, throughout all the angular rotation thereof.

In fact, for a first portion of angular rotation the substantially flat faces 52', 52" and the operative surfaces 67', 67" interact with each other to partially compress the elastomeric body 61, thus urging it from the rest or starting stroke position to an intermediate compressed position. Further, for the next portion of the angular rotation of the door D the plate-shaped element 51 and the operating surface 66 of the interface element 62 interact each other so as to further compress the elastomeric body 61, thus compressing it from the intermediate compressed position to the totally compressed or end stroke position.

This allows to progressively compress the elastic element, so as to obtain a braking effect for the entire angular rotation of the door D.

The embodiment of the hinge 1 shown in FIGS. 11*a* to 13*d* can only open in one direction, while the embodiment shown in FIGS. 18 to 25*d* can open in both opening directions. This allows for an ambidextrous hinge, i.e. to be used both upright and upside down. To this end, the outer surface 44 of the pivot 40 may include a respective pair of operating surfaces 52', which are substantially perpendicular and rounded.

Moreover, in this embodiment the particular shape of the operating surfaces 52' allows to totally control the movement of the door D from the closed position to the fully open one at 180°.

In another preferred but not exclusive embodiment, shown for example in the FIGS. 26*a* to 32, the interface element 62 may be configured as a pushing member 68' and include a protrusion 300, having a generally hemispherical shape. On the other hand, the cam means 50 may include a plurality of seats 310, 320, 330 each corresponding to a supper position of the door.

More in particular, the seats 310, 320, 330 are able to receive the protrusion 300 to supper the door in the supper positions.

Suitably, the seat 310 may correspond to the closed door position, while the seats 320, 330 may correspond to the open door positions. Advantageously, the latter may be mutually opposite with respect to the closed door position.

In a preferred but not exclusive embodiment, the seat 310 corresponding to the closed door position may have a generally "V"-shape with two consecutive planes 311, 312 angled each other with predetermined angle.

Figure 28:
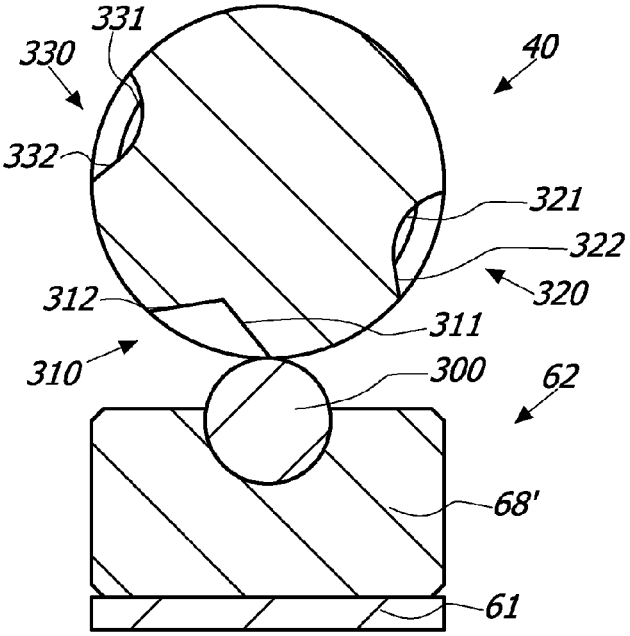

In this way, as particularly shown in FIG. 28, the sliding of the hemispherical protrusion 300 on the planes 311, 312 upon the rotation of the door is simplified, so as to ensure the automatic closing of the door starting from a predetermined angle, for example 20°.

At the same time, the user can rotate the door from the closed door position in both opening directions.

To maximize this effect, the angle between the planes 311, 312 may be at least 90°, preferably at least 110°. In a preferred but not exclusive embodiment, the angle between the planes 311, 312 may be 120°.

Moreover, each of the seats 320, 330 corresponding to the open door positions may advantageously have two consecutive portions 321, 322; 331, 332 having different shape.

The first portions 322; 332 may be generally flat, while the second portions 321; 331 may be countershaped with respect to the shape of the protrusion 300, and in particular may be hemispherical.

In this way, the first flat portions 322; 332 may promote the sliding of the projection 310 thereon to convey it towards the second portions 321; 331, suitable to supper the door.

Figure 29:
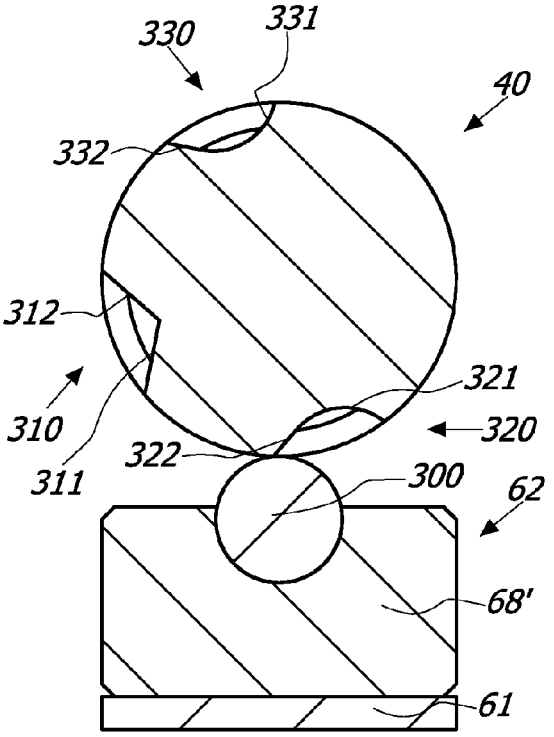

In this way, as particularly shown in FIG. 29, the automatic opening of the door starting from a predetermined angle, for example 70°, is ensured.

Figure 30:
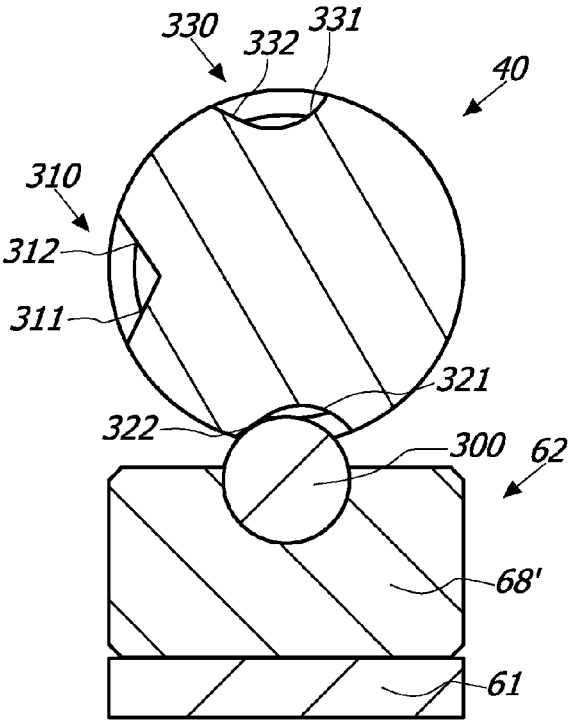
Figure 31:
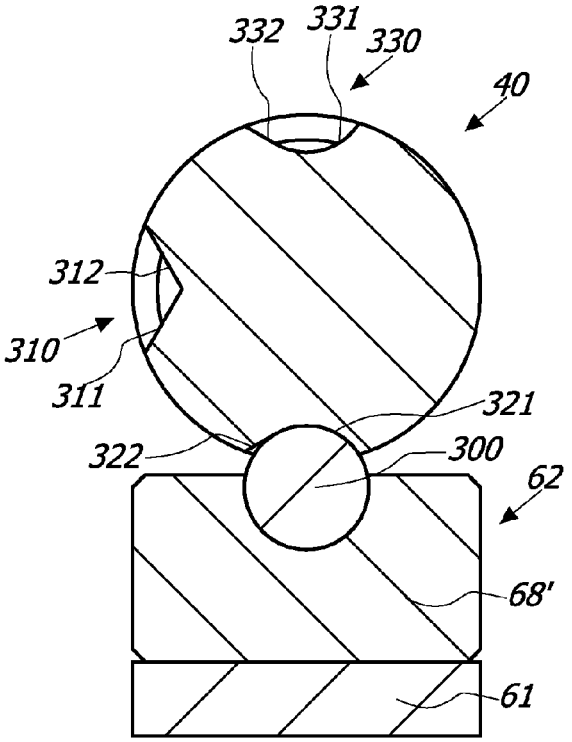

As particularly shown in FIG. 30, the first flat portions 322; 332 act as pilot members for the second hemispherical portions 321; 331, so that the insertion of the protrusion 300 in the latter takes place without noise.

Advantageously, the first flat portions 322; 332 may be substantially perpendicular to the planes 312, 311.

Moreover, thanks to the above configuration the door may be rotated from the supper position only in one direction. In other words, the rotation in the other direction is prevented.

Figure 32:
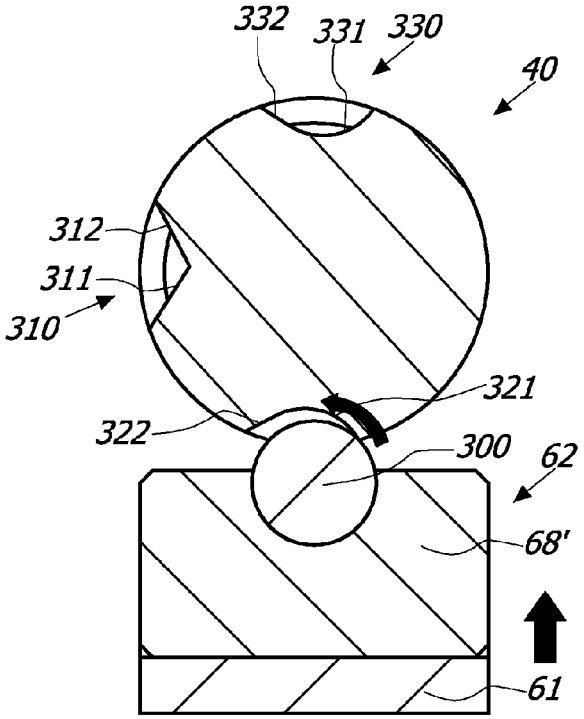

Indeed, as shown in FIG. 32, if a user attempts to further rotate the door, the momentum caused by the elastic counteracting element 61 opposes this force, which momentum urges the one against the other the protrusion 300 and the second portions 321; 331.

Suitably, the elastic counteracting element 61 may be configured so as to allow a further slight rotation of the door after the supper position in the door open position. To this end, the elastic counteracting element 61 after this minimum rotation can reach the position of maximum compression.

This absorbs the shock undergone by the door upon the reaching of the supper position. This configuration is particularly advantageous in the case of glass door, which in the case of abrupt shock could be damaged or broken.

The embodiment of the cam means 50 and the follower means 60 shown in FIGS. 26*a* to 32 and described above is particularly advantageous with the above described elastic counteracting element 61 made of elastomer.

In fact, in the latter a minimum stroke corresponds to a very high strength.

Therefore, suitably precompressing the elastic counteracting element 61 in the working chamber 14 the strength of the hinge 1 is maximized.

Also, the elastic counteracting element 61 made of elastomer maximizes the effect of stopping the rotation, as described above.

In the embodiments of the hinge 1 shown in FIGS. 1 to 13*d*, it is possible to adjust the opening angle of the door D.

For the purpose, an adjusting screw 80 may be provided transversely inserted in the hinge body 11 with a first operating end 81 accessible by a user to adjust the penetration of the former 80 through the corresponding wall of the latter 11 and an opposite end 82 susceptible to come into contact with the plate-shaped element 51.

By appropriately acting on the operating end 81 of the screw 80 the opening angle of the door can be adjusted in a simple and rapid manner, so as to avoid any impact of the door D against the stationary support W.

Moreover, in the embodiment of the hinge 1 shown in FIGS. 18 to 25*d* it is advantageously possible to adjust the precompression of the elastic counteracting element, which in this embodiment consists of the elastomer body 61.

For this purpose, a slide 90 may be provided sliding along the axis Y with a first end 91' interacting with the elastomer body 61 and a second end 91" interacting with a pair of adjusting screws 92.

Therefore, the user can adjust the sliding of the slide along the axis Y by appropriately acting on the screws 92, so as to adjust the precompression of the elastic counteracting element, and consequently the force by which the same elastic counteracting element interacts with the cam means and, consequently, the force thereof upon opening and/or closing of the door.

This is particularly advantageous with the elastomer body 61, in which a precompression of even one millimeter corresponds to an extremely high braking force.

Advantageously, the adjusting screws 92 may be inserted transversely in the connecting plate 11' of the hinge body 11 to define an axis Z' substantially perpendicular to both the axis X and the axis Y. This allows the user to easily act on the operating ends 94 of the adjustment screw 92 without dismounting the hinge.

Therefore, the sliding of the adjusting screws 92 along the axis Z' may result in the interaction between the operative ends 95 having a substantially frustoconical shape and the second end 91" of the slide 90, with the consequent sliding of the latter along the axis Y towards the abutment wall 63'.

Suitably, the adjusting screws 92 may be spaced apart each other, in particular superimposed each other, so as to selectively act on different portions of the body of elastomeric material 61. This allows a user to adjust in a differentiated manner the pushing and/or braking force thereof.

In particular, in embodiments that include the cam elements 51 and 52', 52", the superimposed configuration of the adjusting screws 92 may allow a user to selectively adjust the relative position between the first cam element 51 and the relative operating surface 66 and between the cam elements 52', 52" and the relative operating surfaces 67', 67", so as to differentiate the pushing and/or braking behavior of the hinge.

The hinge 1 is extremely effective and performing, and is also greatly simple to assemble.

For example, with reference to the embodiment shown in FIGS. 1 to 13*d*, the hinge body 11 may have, in addition to the passing-through seat 12 for containing the pivot 40, two passing-through openings 15, 16 to make accessible the working chamber 14 from the outside.

In particular, the first passing-through opening 15 is susceptible to allow the insertion within the working chamber 14 of the follower means 60 and the second opening 16 is susceptible to allow the insertion in the same working chamber 14 of the cam means 50.

The two passing-through openings 15, 16 define two axes perpendicular each other. In particular, the first passing-through opening defines an axis coincident with the axis Y, while the second opening 16 defines an axis Y' perpendicular to both the axis Y and the axis X. In practice, both the cam means 50 and the follower means 60 may be removably inserted in the working chamber 14 by sliding along the plane defined by the axes Y, Y', perpendicular to the axis X.

This is particularly advantageous if it is necessary to change the elastic element 61, for example to insert a softer or harder one in order to vary the braking action of the hinge 1, or to change the plate-shaped element 51, for example to insert one of different configuration to vary the braking action of the hinge 1.

The embodiment of the "Anuba" concealed hinge 1 shown in FIGS. 14 to 17*c*, in addition to the above mentioned features and advantages, is particularly advantageous because it is possible to adjust the position of the door D in the three dimensions, that is both in height and in a plane substantially parallel to the floor as shown for example in FIG. 16*c*.

The hinge 1 may include a lower fixed half-hinge 10 with a hinge body 11 concealedly insertable within the tubular support structure F, CF and a movable upper half-hinge 20 that includes the connecting plate 21 to be anchored to the door D.

As particularly shown in FIGS. 16*a* to 16*d*, the connecting plate 21 is coupled with the fixed half-hinge 10 to extend from the tubular support structure F, CF in the open position, shown in FIGS. 16*c* and 16*d*, and to retract within the tubular support structure F, CF in the closed position, shown in FIGS. 16*a* and 16*b*.

In fact, the connecting plate 21 may include a first portion 25' susceptible to receive the pivot 40 and a second portion 25" susceptible to receive the mounting bracket 30 and to allow the adjustment along the directions d, d', as shown in FIG. 15*b*.

Suitably, the mounting bracket 30 may have a first plate portion 31 operatively fixable to the first portion 25' of the mounting body 24 monolithically coupled with a second plate portion 32, connectable in turn to the door D by means of suitable screws insertable into the holes 33.

The operational connection between the first portion 25' of the mounting body 24 and the first plate portion 31 of the mounting bracket 30 may be made by means of suitable screws 34 inserted through the holes 26 of the mounting body 24 and the openings 35 of the mounting bracket 30 and blockable in suitable blocking elements 36.

By suitably operating on the screws 34 it is possible to move the mounting bracket 30, and then the door D, along the direction d'. In fact, by appropriately unscrewing the screws 34 it is possible to move the mounting bracket 30 for a stroke equal to the length L of the openings 35 in which the screws 34 are inserted.

The movement along the vertical direction d is ensured by the screws 37', 37" inserted through the second portion 25" of the connecting plate 21, the first plate portion 31 of the mounting bracket 30 lying therebetween. As mentioned above, the latter is secured to the former by using the screws 34.

The screws 37', 37" can be operated by unscrewing the screws 34, that allow the movement of the mounting bracket 30 with a stroke equal to the height H of the openings 35 in which the screws 34 are inserted.

To enable movement of the hinge 1 along the direction d", the hinge body 11 may be movably mounted on an anchor plate 100, which may be anchored to the tubular support structure F, CF by using the screws 101.

To this end, a counterplate 102 may be provided, which may be coupled to the hinge body 11 by means of screws 103 to define an interspace 104 therebetween, in which interspace the anchor plate 100 is housed. The interspace 104 may include two side abutment surfaces 105', 105".

Figure 17B:
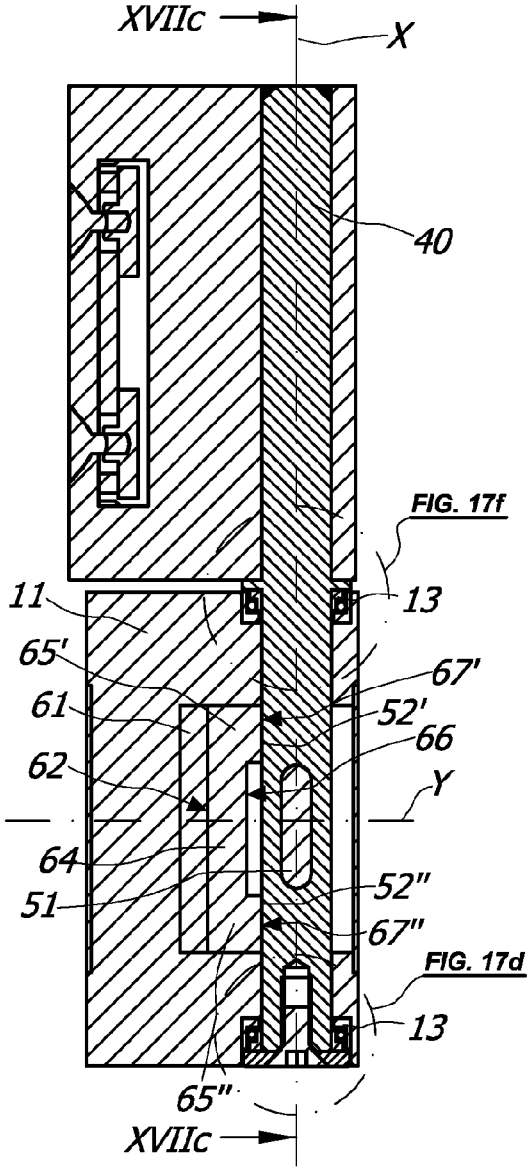
FIGS. 17*a*, 17*b* and 17*c* are respective upper view and views sectioned along a plane XVIIb-XVIIb sectioned along a plane XVIII-XVIII of the embodiment of the hinge 1 of FIG. 14, the hinge being in the closed position.
Figure 17C:
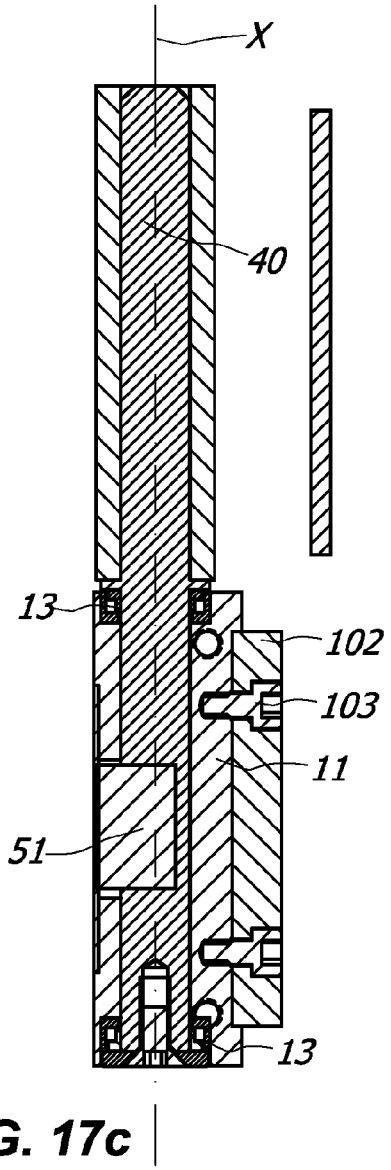
Figure 17A:
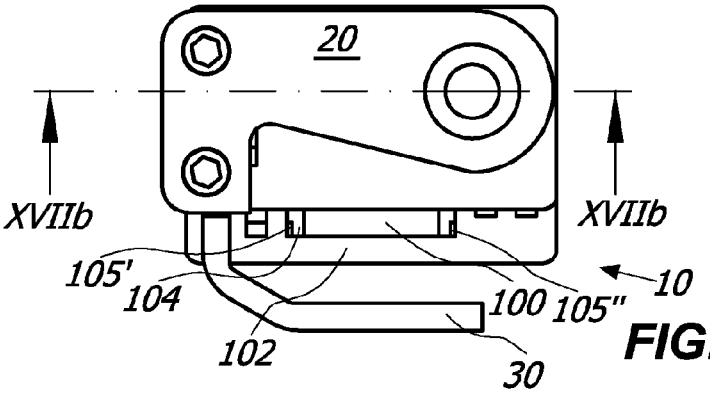
Figure 17E:
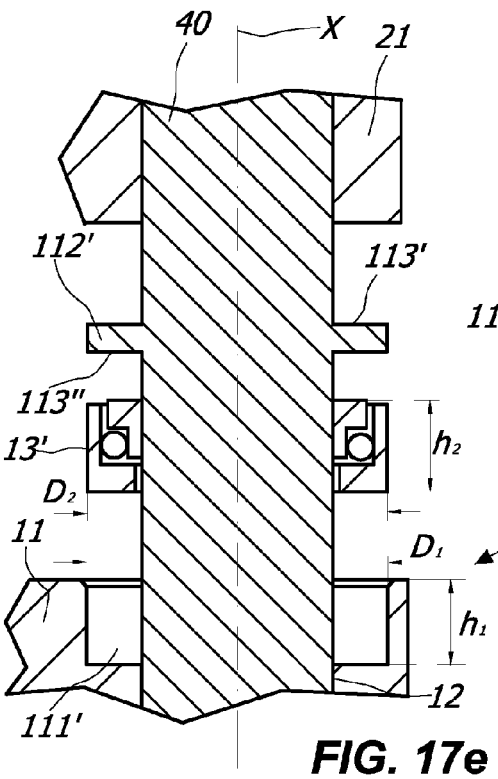
FIG. 17*d* is an enlarged view of some details of FIG. 17*b*, with in FIG. 17*e* an exploded view of such details.
FIG. 17*f* is an enlarged view of further details of FIG. 17*b*, with in FIG. 17*g* an exploded view of such details.
FIG. 17*h* is an exploded perspective view of an embodiment of the hinge 1 similar to the one shown in FIG. 14, in which the body hinge 11 is integral with the baseplate 102.
FIG. 17*i* is a perspective view of the hinge body 11 of the embodiment of the hinge 1 of FIG. 17*h;*
Figure 17D:
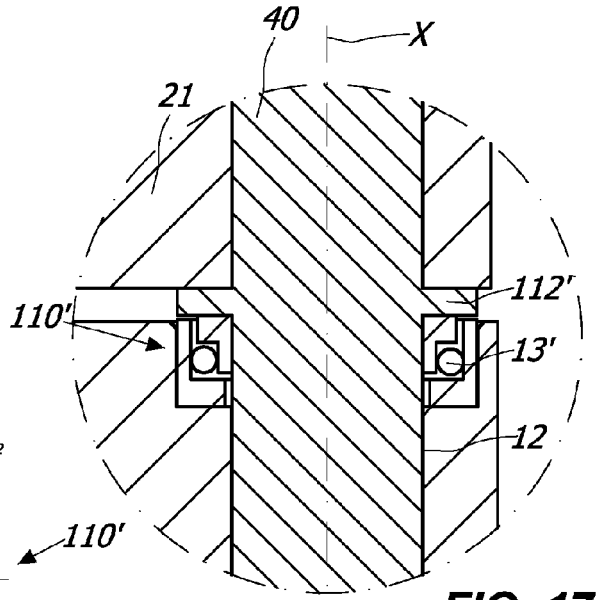
Figure 17F:
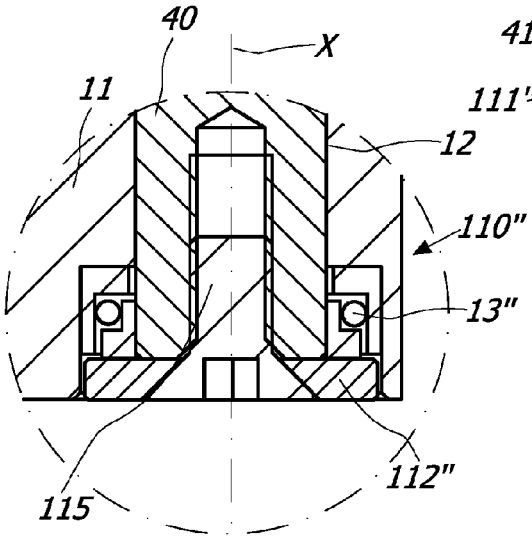
Figure 17G:
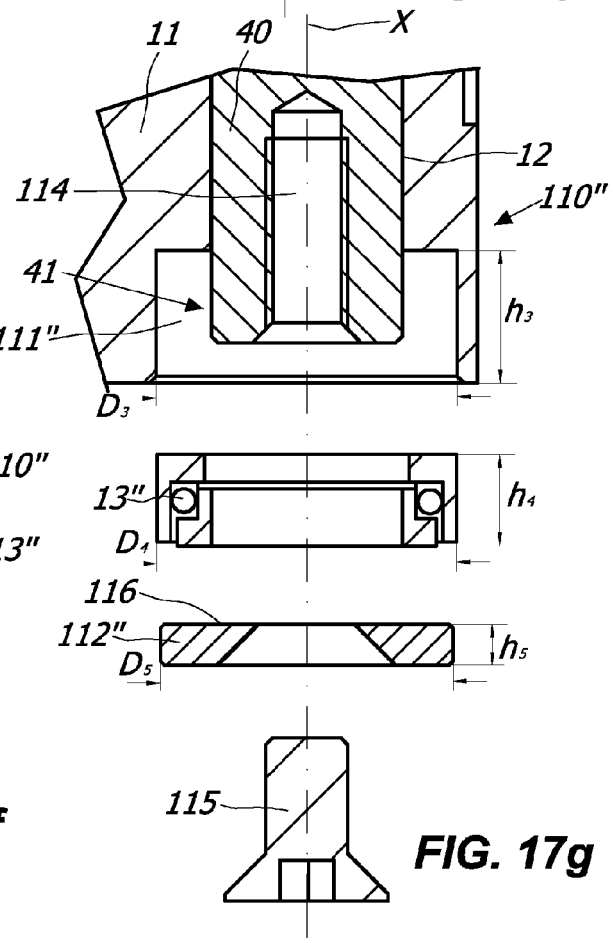
Figures 17H, 17I:
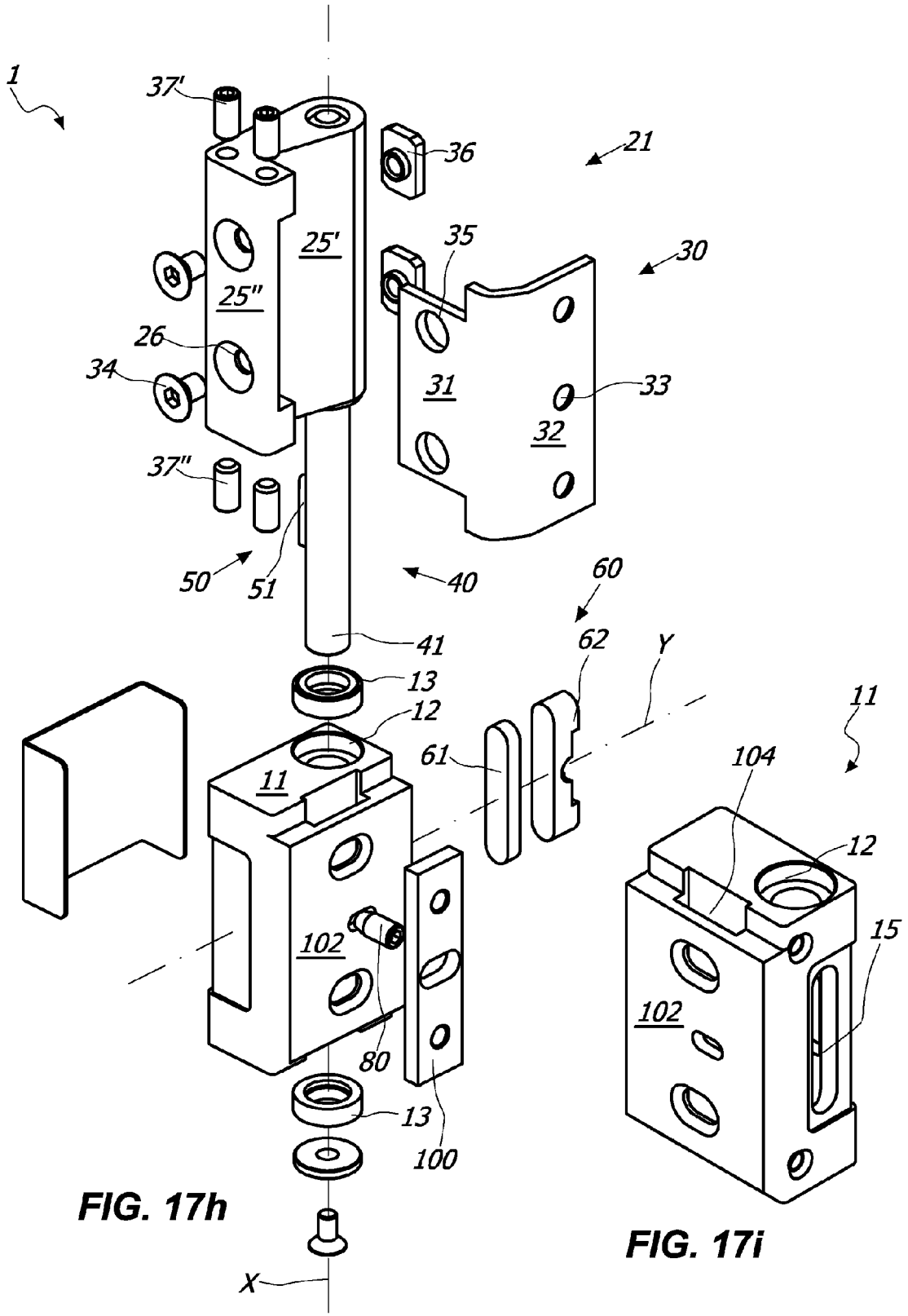
Figure 18:
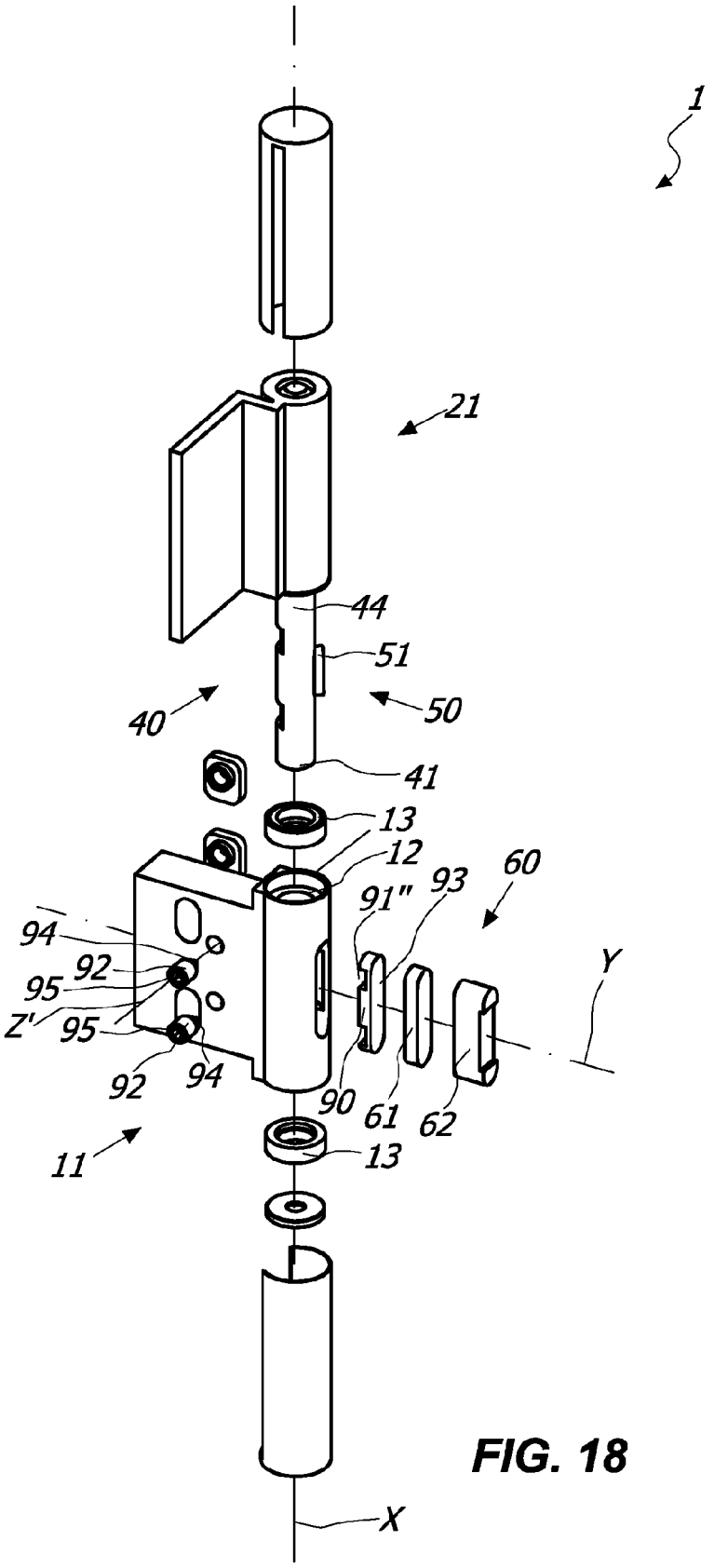
FIG. 18 is an exploded view of a third embodiment of the hinge 1.
Figure 19A:
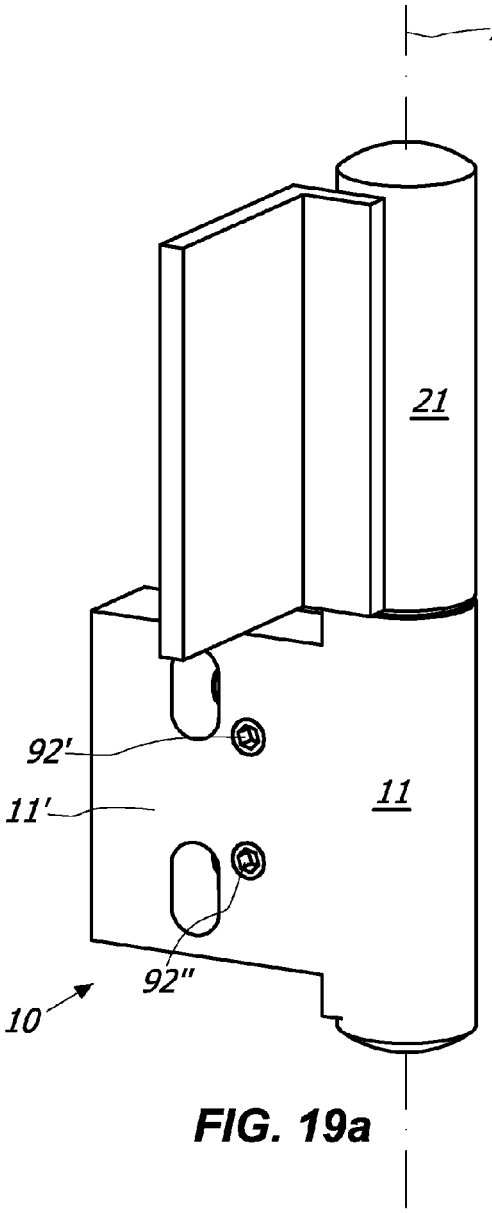
FIGS. 19*a* and 19*b* are perspective views of the embodiment of the hinge 1 of FIG. 18, respectively in the open and the closed position.
Figure 19B:
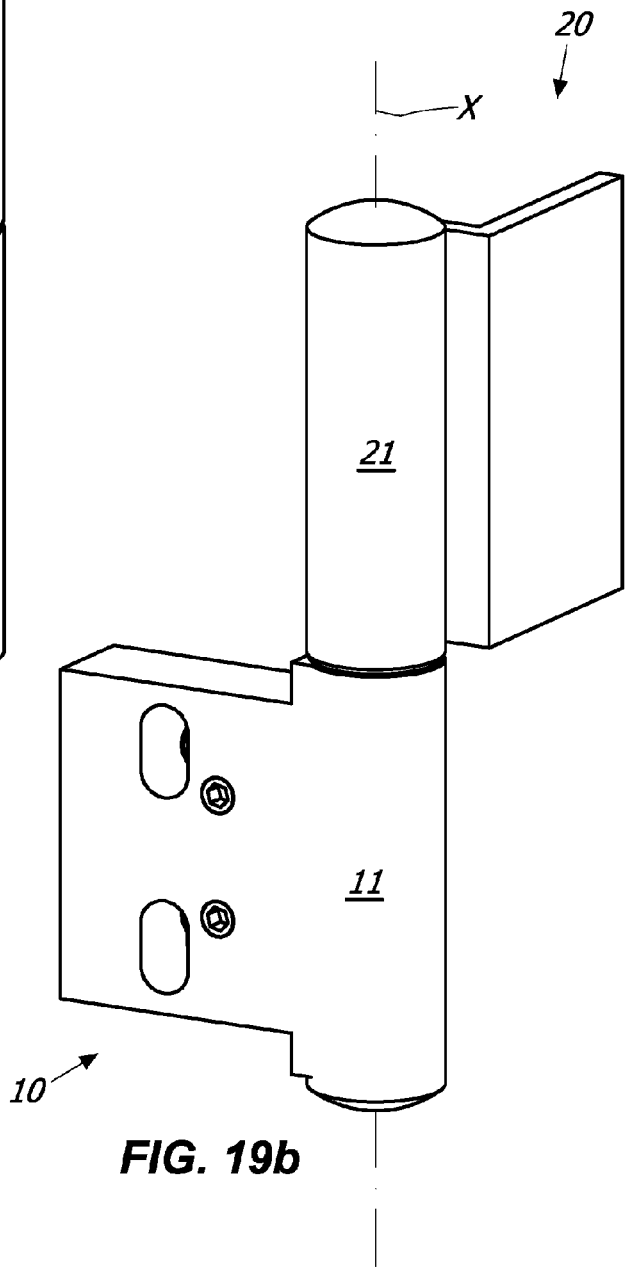
Figure 20A:
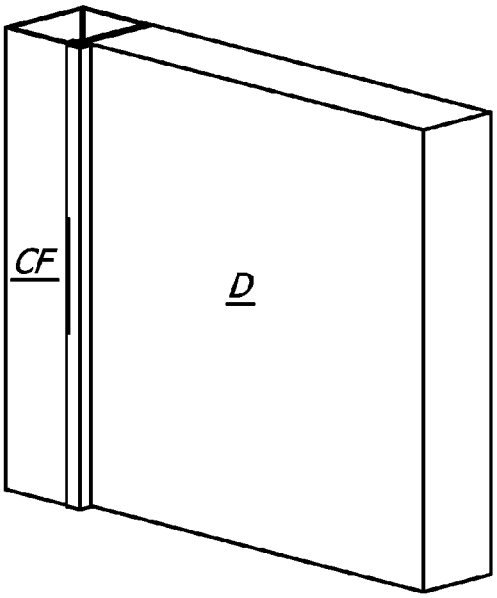
FIGS. 20*a* and 20*b* are perspective and upper views respectively of the embodiment of the hinge of FIG. 1. 18 in which the movable element 20 is mounted on a door D and the fixed element 10 is mounted on a frame F, the door D being in the closed position.
Figure 20B:
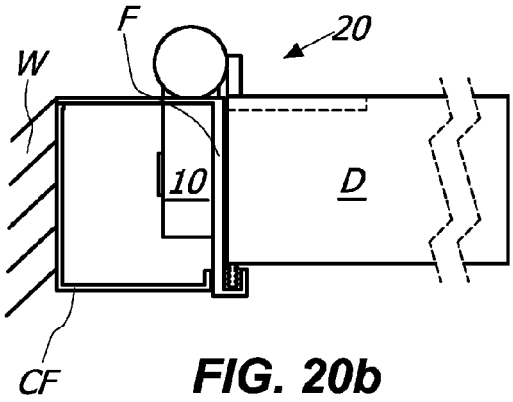
Figure 21A:
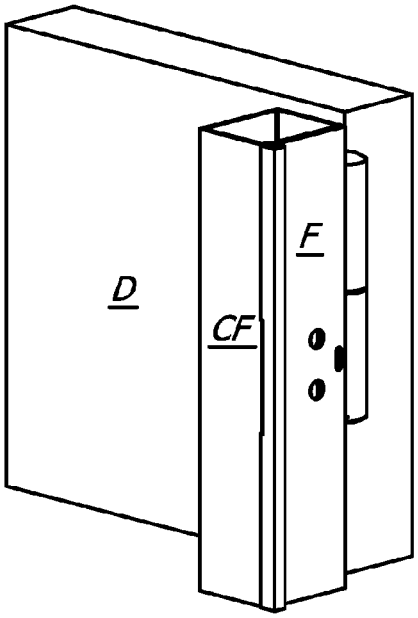
FIGS. 21*a* and 21*b* are respectively perspective and upper views of the embodiment of the hinge 1 of FIG. 18 in which the movable element 20 is mounted on a door D and the fixed element 10 is mounted on a frame F, the door D being in the open position.
Figure 21B:
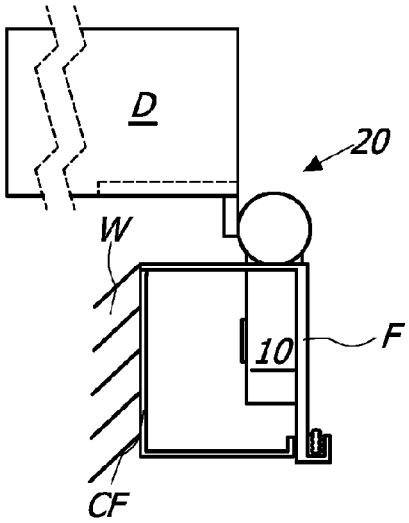
Figure 22B:
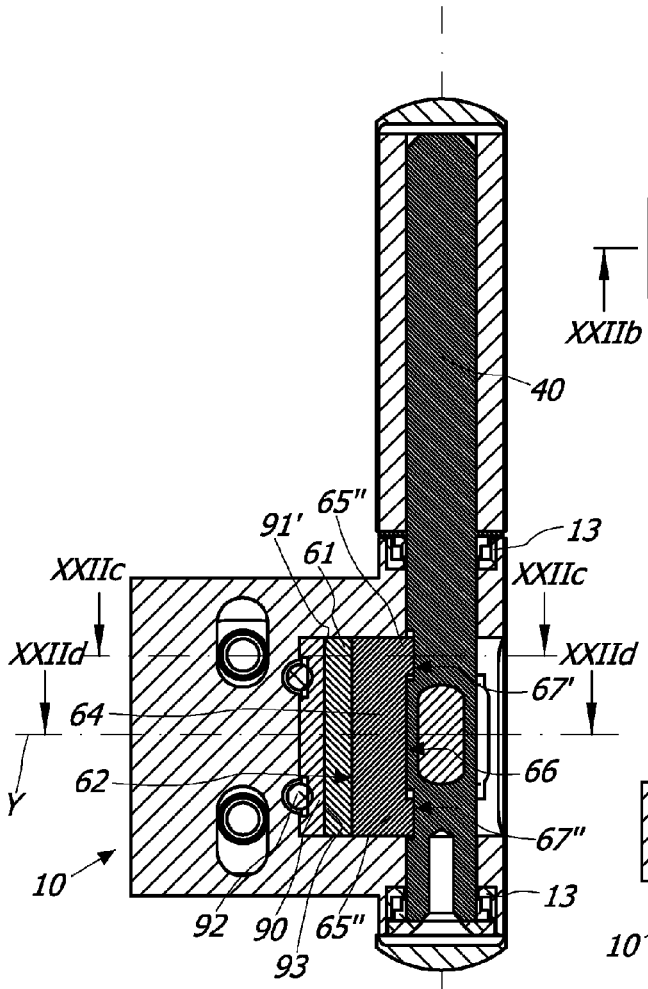
FIGS. 22*a*, 22*b*, 22*c* and 22*d* are respective upper view and views sectioned along a plane XXIIb-XXIIb, along a plane XXIk-XXIk and along a plane XXIId-XXIId of the embodiment of the hinge 1 of FIG. 18, the hinge being in the closed position.
Figure 22A:
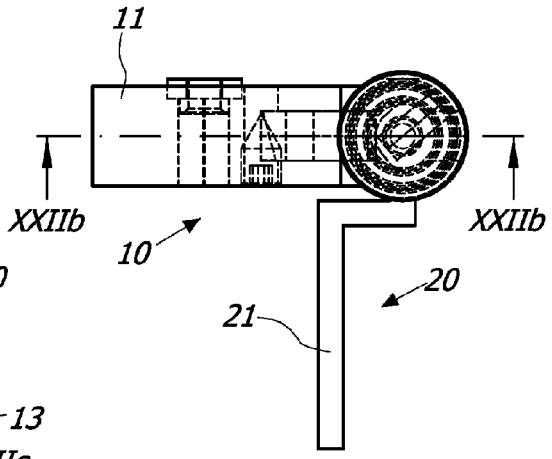
Figure 22C:
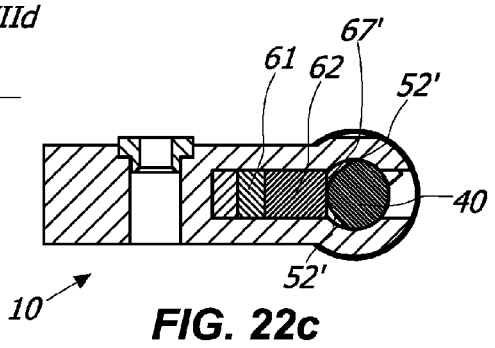
Figure 22D:
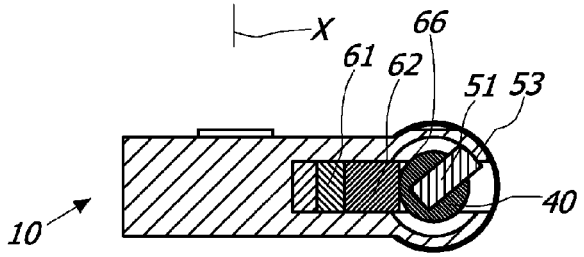
Figures 23A, 23B, 23C, 23D:
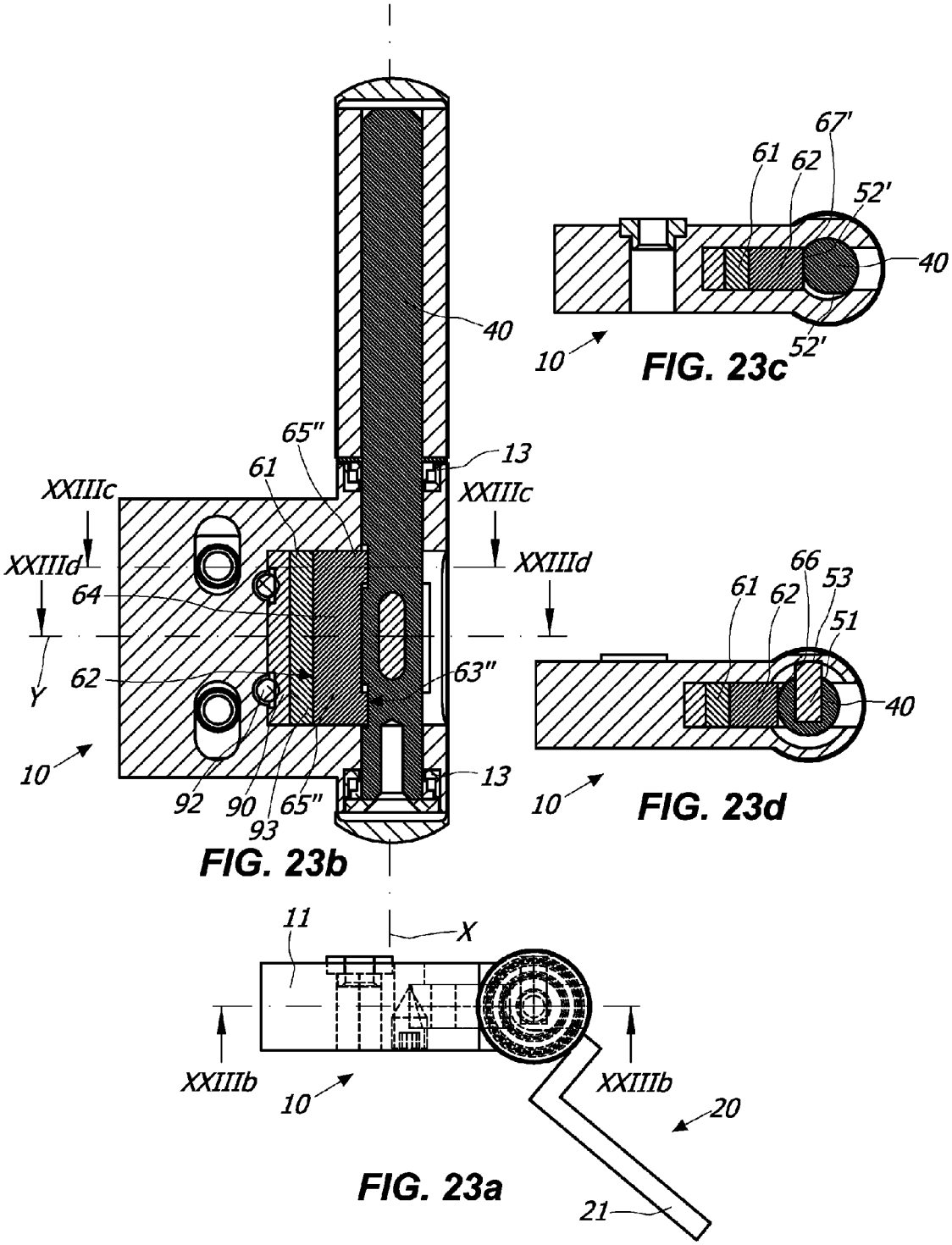
FIGS. 23*a*, 23*b*, 23*c* and 23*d* are respective upper view and views sectioned along a plane XXIIIb-XXIIIb, along a plane XXIIIc-XXIIIc and along a plane XXIIId-XXIIId of the embodiment of the hinge 1 of FIG. 18, the hinge being in a first partially open position.
Figure 24B:
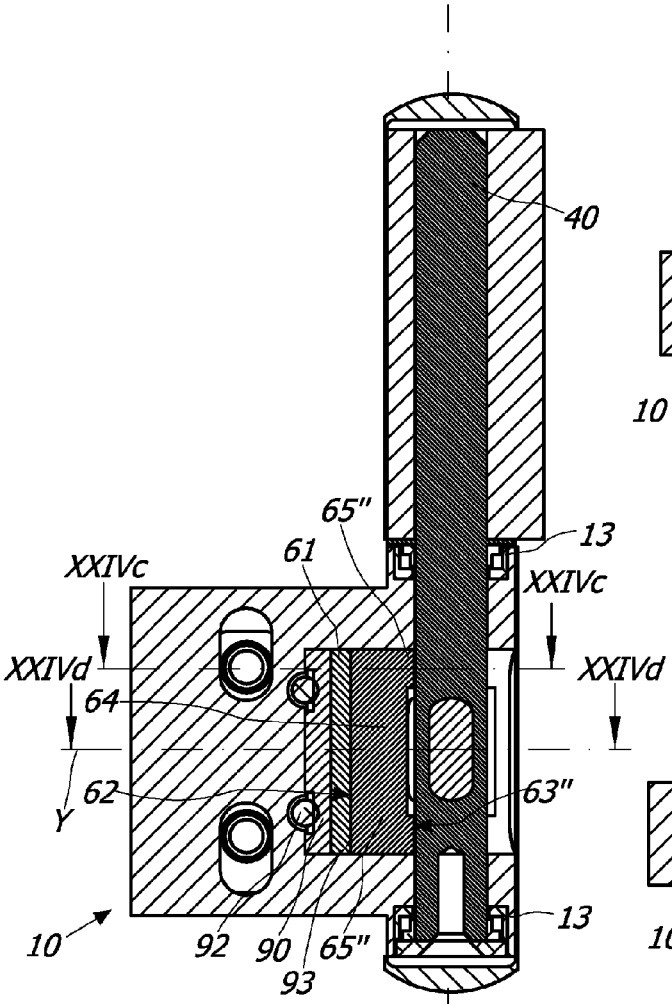
FIGS. 24*a*, 24*b*, 24*c* and 24*d* are respective upper view and views sectioned along a plane XXIVb-XXIVb, along a plane XXIVc-XXIVc and along a plane XXIVd-XXIVd of the embodiment of the hinge 1 of FIG. 18, the hinge being in a second partially open position.
Figure 24C:
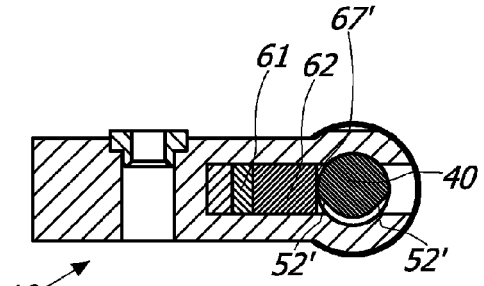
Figure 24D:
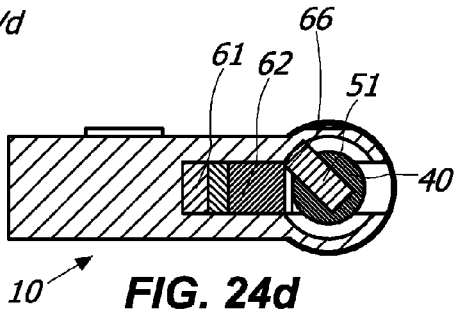
Figure 24A:
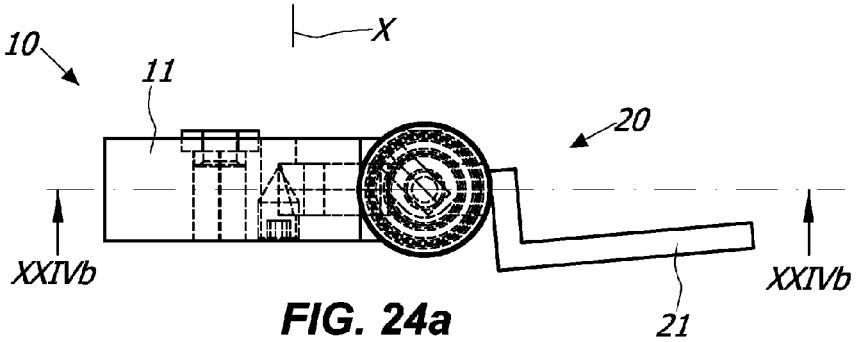
Figures 25A, 25B, 25C, 25D:
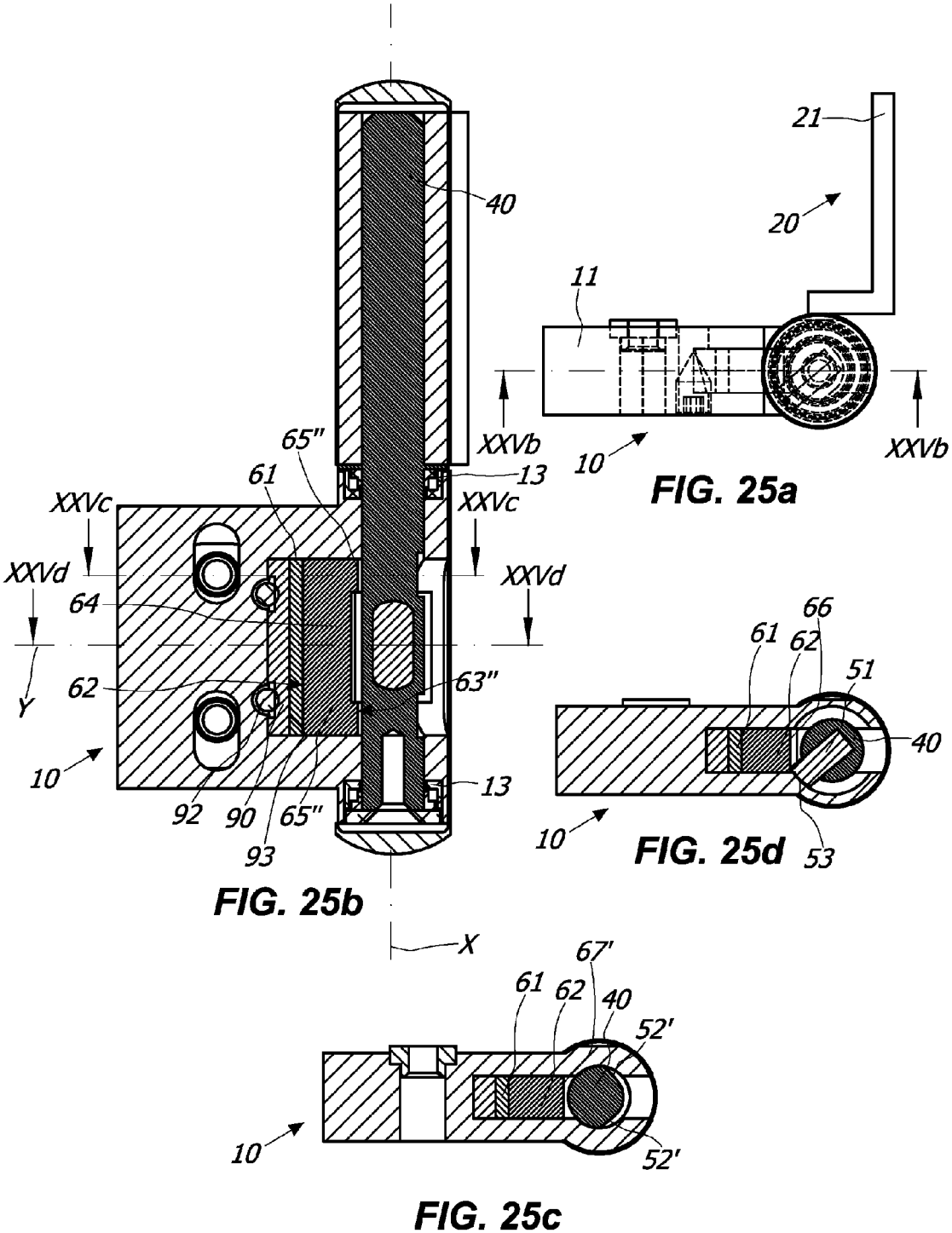
FIGS. 25*a*, 25*b*, 25*c* and 25*d* are respective upper view and views sectioned along a plane XXVb-XXVb, along a plane XXVc-XXVc and along a plane XXVd-XXVd of the embodiment of the hinge 1 of FIG. 18, the hinge being in the fully open position.
Figure 26A:
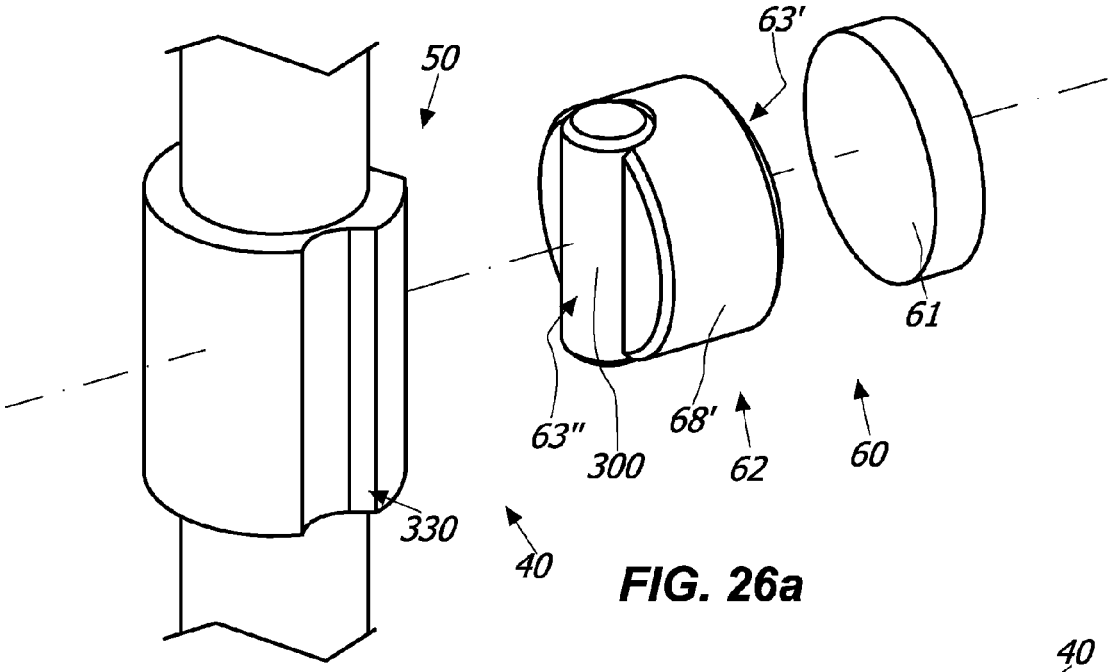
FIGS. 26*a* and 26*b* are respectively perspective and sectional partly cut views of some details of a further embodiment of the cam means 50 and the follower means 60.
Figure 26B:
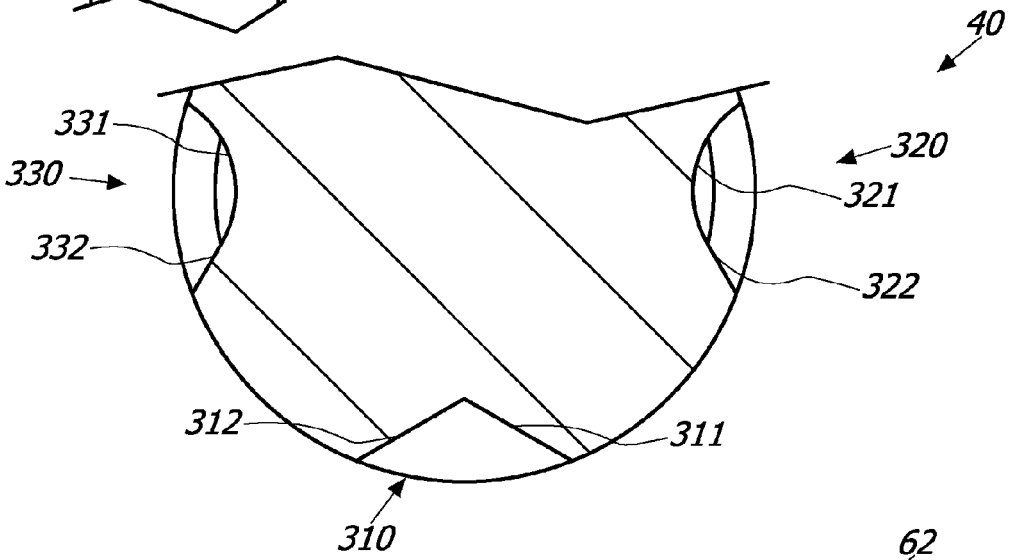
Figure 26B:
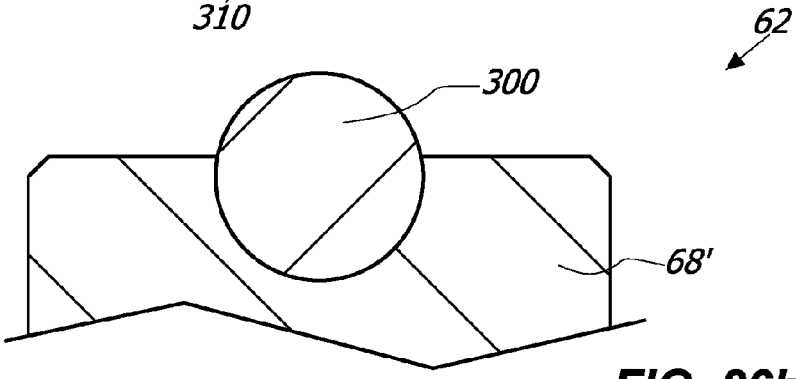
Figure 27:
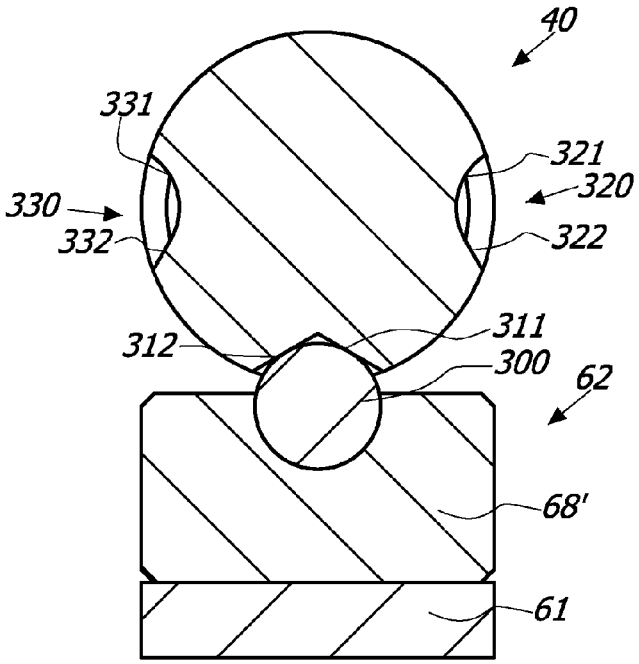
FIGS. 27 to 32 are sectional views of the cam means 50 and follower means 60 of FIGS. 26*a* and 26*b* in various operational steps, in which for each step the relative position of the cam means 50, the pushing member 68' and the elastic counteracting element 61 is enlargedly shown.

In the alternative embodiment shown in FIGS. 17*h* and 17*i*, the counterplate 102 may be integrated into the hinge body 11, i.e. the two parts can be made in a single piece. This allows to provide a more economic hinge 1.

The screws 101 are engageable in the anchor plate 100 by passing through the slots 106 of the counterplate 102.

By appropriately acting on the screws 101 it is possible to move the assembly of the hinge body 11 and the counterplate 102, and then the door D, along the direction d". In fact, by suitably unscrewing the screws 101, it is possible to move the assembly between the hinge body 11 and the counterplate 102, and hence the hinge 1, for a stroke equal to the length L' of the slots 106 in which the screws 101 are inserted and/or the distance between the side abutment surfaces 105', 105" of the interspace 104.

The embodiments of the hinge 1 of the "Anuba" type shown in FIGS. 14 to 25*d* can be designed to minimize friction between the fixed half-hinge 10 and the movable half-hinge 20.

For this purpose, the upper end 110' of the seat 12 may include a respective upper annular housing 111' suitable to receive a respective upper antifriction element 13', such as a bearing.

As particularly shown in FIGS. 17*d* and 17*e*, the pivot 40 may include a upper radial expansion 112', for example a flange, with an upper operating surface 113' susceptible to come in contact with the connecting plate 21 and a lower operating surface 113" susceptible to remain faced to the upper annular housing 111'.

Advantageously, the upper annular housing 111' and the upper antifriction element 13' may be mutually configured so that the lower operating surface 113" of the upper radial expansion 112' is susceptible to abut against the upper antifriction element 13'. In this way, the pivot 40 can rotate onto the upper antifriction element 13' by remaining mutually spaced from the hinge body 11.

To this end, the inner diameter $D_1$ of the upper annular housing 111' may be substantially equal to the outer diameter $D_2$ of the upper antifriction element 13', while the height $h_2$ of the latter may be slightly greater than the height $h_1$ of the former, for example a few tenths of a millimeter.

Furtherly, the lower end 110" of the seat 12 suitably includes a lower annular housing 111" susceptible to receive a respective lower antifriction element 13".

The lower end 41 of the pivot 40 may include a blind axial hole 114 susceptible to receive a blocking screw 115. A pressure element 112" may further be provided, for example a washer, susceptible to be interposed between the blocking screw 115 and the lower antifriction element 13" to define a lower radial expansion. Advantageously, the latter may include an upper operative surface 116 susceptible to remain faced to the lower annular housing 111".

The latter, the lower antifriction element 13" and the pivot 40 may be mutually configured so that the upper operative surface 116 of the pressure element 112" is susceptible to abut against the pivot 40 and to remain spaced apart from the lower antifriction element 13".

In this way, the possible reaction force due to the rotation of the pivot 40 at its lower end 41 is loaded on the lower antifriction element 13".

This prevents the slipping of the pivot 40 from the seat 12 and/or the misalignment of the same pivot 40.

To minimize friction between the lower fixed half-hinge 10 and the upper half-hinge 20, the inner diameter $D_3$ of the lower annular housing 111" may be substantially equal to the outer diameter $D_4$ of the lower antifriction element 13", while the outer diameter $D_5$ of the pressure element 112" may be slightly less than the inner diameter $D_3$ of the lower annular housing 111".

Moreover, the height $h_3$ of the latter may suitably be substantially equal to the sum of the height $h_4$ of the lower antifriction element 13" and the height $h_5$ of the pressure element 112".

Advantageously, the upper and lower antifriction elements 13', 13" may consist of bearings of the axial-radial type, in order to suitably load thereon both the axial and the radial stresses due to the weight of the door D and/or their reactions forces.

From the above description, it is apparent that the hinge 1 fulfils the intended objects.

The hinge 1 is susceptible to many changes and variants. All particulars may be replaced by other technically equivalent elements, and the materials may be different according to the needs, without exceeding the scope of the invention defined by the appended claims.

The invention claimed is:

1. A hinge for coupling a door and a stationary support structure, the hinge comprising:

a fixed element to be coupled to the stationary support structure;

a movable element to be coupled to the door, the fixed element and the movable element being rotatably coupled each other to rotate about a first longitudinal axis;

wherein one of said movable element and fixed element includes a hinge body, the other of said movable element and fixed element including a pivot extending along said first axis;

wherein said pivot includes a cam member rotating about said first longitudinal axis, said hinge body including at least one working chamber extending along a second longitudinal axis perpendicular to said first axis, said at least one working chamber including a follower member reciprocally interacting with said cam member for sliding along said second longitudinal axis between a first end-stroke position and a second end-stroke position, said follower member including at least one elastic counteracting element;

wherein said cam member includes at least one first cam element and at least one second cam element mutually superimposed along said first axis, the at least one first cam element being configured to move said follower member from one of said first and second end stroke positions to a third position which is intermediate therebetween and vice-versa, said at least one second cam element being configured to move the follower member from said third intermediate position to the other of said first and second end stroke positions and vice-versa;

wherein said follower member includes at least one interface element interposed between said pivot and said at least one elastic counteracting element, said at least one interface element comprising at least one first operating surface and at least one second operating surface, said at least one first operating surface and at least one second operating surface being mutually superimposed to sequentially interact respectively with said at least one first cam element and with said at least one second cam element and vice-versa.

2. The hinge according to claim 1, wherein said at least one elastic counteracting element includes an elastomeric body.

3. The hinge according to claim wherein said elastomer is compact polyurethane.

4. The hinge according to claim 3, wherein said elastomer has a Shore A hardness of 50 ShA to 95 ShA.

5. The hinge according to claim 1, wherein said at least one interface element has a first end interacting with said at least one elastic counteracting element and a second end interacting with said at least one first cam element and with said at least one second cam element.

6. The hinge according to claim 1, wherein said at least one interface element includes a central elongated portion defining a third longitudinal axis parallel to said first axis and at least one end transverse appendix perpendicular to said first axis, said central elongated portion including said at least one first operating surface, said at least one end transverse appendix including said at least one second operating surface.

7. The hinge according to claim 6, wherein said pivot includes a cylindrical outer surface including at least one flat face defining said at least one second cam element.

8. The hinge according to claim 7, wherein said at least one second operating surface is planar, said cam member and said follower member being configured so that said at least one flat face and said at least one second operating surface are parallel and mutually contact engaged when the movable element is in a closed position and are perpendicular to each other and mutually spaced apart when the movable element is in an open position.

9. The hinge according to claim 8, wherein said pivot includes an elongated appendix transversely extending along said second axis to define said first cam element, said elongated appendix including a peripheral edge configured to contact engage the first operating surface of said interface element to progressively interact with said elastic counteracting element.

10. The hinge according to claim 9, wherein said elongate appendix defines a plane perpendicular to said at least one flat face of said second cam element.

11. The hinge according to claim 1, wherein said at least one elastic counteracting element is interposed between a first abutment wall and a second abutment wall, said at least one interface element having a first end defining said first abutment wall, wherein the hinge further comprises adjustment means for adjusting the preload of said at least one elastic counteracting element which include a slide sliding along said second axis having a first end defining said second abutment wall and a second end opposite thereto, said adjustment means further including at least one adjustment screw having a first active end configured to interact with the second end of said slide and a second operating end accessible from outside by a user to adjust the sliding of the slide along said second axis.

12. The hinge according to claim 11, wherein said hinge body comprises at least one connecting plate for coupling thereof to the stationary support structure or to the door, said at least one working chamber including said adjustment means, said at least one adjustment screw being transversely inserted within said at least one connecting plate to define a fourth axis perpendicular to both said first axis and said second axis.

13. The hinge according to claim 12, wherein said first active end of said at least one adjustment screw has a generally fustoconical shape to come into contact engagement with the second end of said slide, so that the penetration of said at least one adjustment screw along said fourth axis induces the sliding of said slide along said second axis towards said first abutment wall.

14. The hinge according to claim 13, wherein said adjustment means include at least one pair of adjusting screws spaced apart each other.

15. The hinge according to claim 14, wherein each of the adjusting screws of said pair selectively acts on different portions of said elastomeric body.

16. The hinge according to claim 15, wherein said adjusting screws of said pair being mutually superposed to enable a user to selectively adjust the relative position between said at least one first cam element and said at least one first operating surface and between said at least one second cam element and said at least one second operating surface.

* * * * *